US006771916B2

(12) United States Patent
Hoffman et al.

(10) Patent No.: US 6,771,916 B2
(45) Date of Patent: Aug. 3, 2004

(54) AIR QUALITY MANAGEMENT APPARATUS FOR AN ELECTROSTATOGRAPHIC PRINTER

(75) Inventors: Gary P. Hoffman, Middlesex, NY (US); Michael Kurt Rainer Schoenwetter, Rochester, NY (US); Carl Allen Luft, Lima, NY (US); John Franklin Quester, Hilton, NY (US); Phillip Henry Blank, Holley, NY (US); John Walter May, Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 265 days.

(21) Appl. No.: 10/008,298

(22) Filed: Nov. 13, 2001

(65) Prior Publication Data

US 2003/0091363 A1 May 15, 2003

(51) Int. Cl.[7] ..... G03G 21/20

(52) U.S. Cl. ..... 399/92; 399/93; 399/97; 399/98

(58) Field of Search ..... 399/91, 92, 93, 399/97, 98

(56) References Cited

U.S. PATENT DOCUMENTS 5,918,089 A * 6/1999 Malinich et al. ..... 399/88

6,308,026 B1 10/2001 Kouchi ..... 399/110

FOREIGN PATENT DOCUMENTS

| | | |
|---|---|---|
| EP | 0 629 931 A1 | 12/1994 |
| JP | 2000-89647 | 3/2000 |

* cited by examiner

*Primary Examiner*—Hoan Tran
(74) *Attorney, Agent, or Firm*—Lawrence P. Kessler

(57) ABSTRACT

An air quality management apparatus for use in a modular electrostatographic color printer. For air quality management a non-air-conditioned open-loop portion is provided for managing quality of air in a first interior volume, and an air-conditioned recirculation portion is provided for managing quality of air in a second interior volume. The first interior volume includes a fusing station for fusing color images on receiver members. The second interior volume includes a number of tandemly arranged image-forming modules, as well as an auxiliary chamber associated with, yet isolated from, each module, such that air-conditioned air flowing through each module does not mix with air-conditioned air supplied to the modules and to devices within the modules. The second interior volume is differentiated from the first interior volume by at least one separating member. The air-conditioning device is for controlling temperature and relative humidity of air included in the second interior volume.

67 Claims, 14 Drawing Sheets

AIR QUALITY MANAGEMENT APPARATUS FOR AN ELECTROSTATOGRAPHIC PRINTER

FIELD OF THE INVENTION

The invention relates to electrophotographic printing, and more particularly to apparatus and method for managing air quality within an electrophotographic printing machine.

BACKGROUND OF THE INVENTION

The aerial environment within modern high quality output electrostatographic color printing machines must be managed to provide efficient operation. Such color printing machines include a number of tandemly arranged electrostatographic imaging-forming modules. In each module of such a printing machine, a respective single-color toner image may be electrostatically transferred directly from a respective moving primary image-forming member to a moving receiver member, thereby successively building up a full-color toned image on the receiver. More typically, in each module of such an electrostatographic color printing machine, a respective single-color toner image is electrostatically transferred from a respective moving primary image-forming member, e.g., a photoconductive member, to a moving intermediate transfer member, and then subsequently electrostatically transferred from intermediate transfer member to a moving receiver member. In certain printing machines, the receiver member is moved progressively through the imaging-forming modules, wherein in each module the respective single-color toner image is transferred from the respective primary image-forming member to a respective intermediate transfer member and from thence to the moving receiver member, the respective single-color toner images being successively laid down one upon the other on the receiver member so as to complete, in the last of the modules, a full-color toner image, e.g., a four-color toner image, which receiver is then moved to a fusing station wherein the full-color toner image is fused to the receiver. Alternatively, the respective single-color toner images formed in respective modules are transferred atop one another to form a composite full-color toner image on the intermediate transfer member, and the composite image is then transferred to the moving receiver member, which receiver is subsequently moved to a fusing station where the composite image is fused to the receiver. In order to achieve a superior image quality in a modular electrostatographic color printer, important essential parameters include keeping levels of aerial contamination low, as well as providing a stable relative humidity and temperature for all the modules.

In a prior art color electrostatographic printing or color copying machine in which the internal relative humidity (RH) is unregulated, the RH inside such a machine depends upon the relative humidity in the ambient air surrounding the machine, i.e., the internal RH varies from day to day and from season to season. Moreover, even when the ambient relative humidity is stable, the RH inside a modular electrostatographic printer in which the interior environment is unregulated can vary substantially from module to module, and this can have serious consequences for image quality.

It is well known that relative humidity can have a strong influence on the charge-to-mass ratio of toner particles included in a developer for use in a toning station. Thus, if the RH varies within a given module of a modular printer in response to a change of ambient RH or ambient temperature, an image density produced by the corresponding toner on a receiver will also vary, unless well known countermeasures are taken, such as for example adjusting the imaging exposure of the corresponding photoconductive primary imaging member, or adjusting the charging voltage for corona sensitization of the corresponding photoconductive primary imaging member. More seriously, if in response to a change of ambient RH the relative humidity varies within all the toning stations included in the modules of a modular printer, the resulting variations of charge-to-mass ratio from module to module will generally be quite different, because a different developer composition is generally used for each color toning station, and the charge-to-mass ratio of each such developer composition has its own characteristic dependence upon RH. Therefore, unless the above-mentioned countermeasures are taken separately for each of the toning stations (which can be costly and cumbersome) a change of ambient RH in a printer in which the interior environment is unregulated will generally produce different amounts of resulting density change for the different colored toners in a full-color toner image, which is clearly undesirable.

Moreover, changes of RH can produce unwanted changes of photoconductive sensitivity, which changes may require compensation, e.g., by raising or lowering the charging voltage prior to an imaging exposure.

Similarly, changes of RH in a modular machine in which the interior environment is unregulated can produce unwanted changes of resistivity of intermediate transfer members, thereby affecting efficiency of dependent, and therefore changes of RH in a machine in which the interior environment is unregulated electrostatic toner transfer from primary imaging members to intermediate transfer members, and from intermediate transfer members to receiver members. For maintaining a constant transferred density of toner to a receiver, such changes of resistivity may require adjustments of applied voltages, which applied voltages are for example typically applied to intermediate members and to transfer rollers included in the modules.

Moreover, moisture absorption by paper receiver sheets typically causes swelling of the paper, and different sheets within an imaging run may be swelled to different degrees, e.g., depending on how receiver sheets are stacked in the machine prior to use. Swelling due to moisture may also be variable from place on a given sheet, e.g., depending on how uniformly receiver sheets are manufactured. Typically, moisture contained in receiver sheets produces image defects when the sheets pass through the heated rollers of a fusing station. Such image defects include disruption of toner images by steam generated during fusing, as well as non-uniform deformation or buckling of receiver sheets in a fusing station. Also, the moisture content within a paper receiver affects efficiency of electrostatic transfer of toner to the receiver, and consequently an applied transfer bias voltage will generally require adjustments to compensate for changes in moisture content caused by changes of RH. Such adjustments disadvantageously require specialized extra equipment in the machine. Moreover, if moisture content is nonuniformly distributed in such a receiver, efficiency of electrostatic transfer may be different from place to place on the receiver, thereby causing further image defects, e.g., transfer mottle. In order to mitigate these problems in electrostatographic printers, paper receiver members may be conditioned in a pre-conditioning station at a specified RH and temperature in order to keep moisture content within predetermined limits prior to use, thereby improving the reproducibility of image quality from sheet to sheet and reducing moisture-induced defects. Nevertheless, when paper pre-conditioning is carried out and the interior environment of the printer is otherwise unregulated for relative humidity, ambient-induced variations of RH inside the printer can still be harmful, as described above.

Inasmuch as relative humidity is determined by the absolute humidity as well as by the temperature, variations of temperature within an electrostatographic printer will therefore cause corresponding local changes in relative humidity. Thus, in a machine in which the interior temperature is unregulated, local fluctuations of ambient temperature will generally affect the local RH, and in a modular machine, module-to-module variations of temperature will generally give rise to corresponding changes of RH, even when ambient air is flowed through the machine, e.g., for purpose of ventilating the machine.

Furthermore, fluctuations of temperature within an electrostatographic modular printer are undesirable in view of the fact that many key components, e.g., metal drums, are required to have precise dimensions, which dimensions may change unacceptably when there is a change in interior temperature. A change in interior temperature may for example be caused by a change in the ambient temperature outside a machine in which the interior temperature is unregulated. In a modular machine in which the interior temperature is unregulated, the interior temperature may be uncontrollably different from one module to another, and dimensional changes of components in a module will generally be different in the different modules, thereby adversely affecting registration of individual single-color toner images making up a full-color toner image on a receiver. Whilst such dimensional changes of components can sometimes be compensated for, e.g., by compensatory programming of laser or LED writers used for exposing photoconductive primary imaging members, such compensation can be costly and complex to carry out.

It is also well known that photodischarge characteristics of a photoconductive primary imaging member, e.g., quantum efficiency and photocarrier trapping, are typically temperature dependent. Thus, in a modular electrophotographic color printer in which temperature is unregulated, the photodischarge behaviors of the respective photoconductive primary imaging members will tend to vary in uncontrollable fashion from module to module as ambient temperature outside the printer changes. Such changes of photodischarge behaviors need to be compensated for if toner image densities for the individual colors are to be maintained within predetermined limits.

Considerable amounts of heat are generated within an electrostatographic printing machine, and this heat is generally generated nonuniformly at different locations within the machine. Inasmuch as the imaging operations within the machine and the mechanisms for generating aerial contamination within the machine are generally heat-dependent, it is clearly desirable to manage the heat, usually by providing mechanisms for cooling the interior of the printer and dissipating the heat to locations outside the machine, including dissipation of heat generated by the cooling mechanisms themselves. Such dissipation of heat may be accomplished by flowing air through at least a portion of the machine, thereby transferring the heat to the flowing air.

The efficiency of operation of a corona charger is dependent upon both relative humidity and temperature, and typically many corona chargers are used in conjunction with the imaging modules included in a modular electrostatographic color printer. Moreover, generation rates of contaminants such as ozone and oxides of nitrogen ($NO_x$) are dependent upon relative humidity and temperature, thereby causing potential problems with contamination levels if the RH or temperature varies widely within a printer in which the interior environment is unregulated, e.g., from module to module.

It is well known that ozone generated by corona chargers can cause premature aging of plastic or polymeric components within an electrophotographic color printer. Thus, ozone attacks organic photoconductors used for primary imaging members, thereby decreasing photoconductive performance and causing physical degradation, such as cracking. Similarly, $NO_x$ reacts with water vapor to produce acids such as nitric acid, which acids when present on a surface of a primary imaging member can cause large increases in surface conductivity, with resultant disadvantageous blurring of electrostatic latent images formed on the primary imaging member. As known in the art, ozone or $NO_x$ produced by a primary corona charger for charging a photoconductive primary imaging member may be removed from the charger and from the vicinity of the adjacent photoconductive surface by entraining the ozone or $NO_x$ in an airflow specifically associated with the charger. Moreover, because ozone is harmful to humans, ozone is typically filtered out of air within the printer, so that any air leaving the printer and returning to the ambient air outside the printer must lawfully contain an ozone concentration which conforms to government standards.

Amines, which may be present in the air inside an electrostatographic engine, can seriously affect image quality. When the relative humidity and the concentration of amines within the electrostatographic engine are both high, a latent image tends to become less sharp and may develop large-scale blurring. Even at low amine concentrations, the resulting image spreading may disadvantageously cause micro-blurring of latent image dots in half-tone latent images. Amines can also react chemically with $NO_x$ molecules typically produced by corona chargers, thereby forming hard-to remove ammonium salt deposits which can build up on a photoconductor surface. In the presence of adsorbed water molecules, a conductive layer of surface electrolyte is effectively produced from these ammonium salts, thereby causing a worse latent image blurring than may be caused by $NO_x$ alone. Amines can originate from sources external to an electrophotographic machine, or from sources within a machine. Typical external sources of amines are humidification systems in which steam is generated and added to the ambient air, e.g., in commercial establishments such as factories and offices in which an electrostatographic printer may be located. Cyclohexylamine is a commonly used amine additive for use as a corrosion inhibitor in such humidification systems, which amine additive is volatilized with the steam. Morpholine may also be used as an amine additive. Resulting ambient aerial amine concentrations produced by such humidification systems are often sufficiently high so as to cause serious problems in electrophotographic imaging, especially in winter when such humidification systems are in operation. Other external source of amines are ammonia-containing cleaning solutions such as may be used on or near an electrostatographic printer, including floor cleaners. Still other external sources of amines are diazo printers and blueprint machines that may be located near an electrostatographic printer. Internal sources of amines within an electrophotographic machine may be associated with non-metal machine components, such as for example epoxies used for bonding of machine parts, which epoxies may emit amines such as polyoxyalkyleneamine and aminoethylpiperazine. For high resolution printing, it is therefore desirable to remove such amines from air inside imaging regions of an electrostatographic printer, especially from air associated with primary corona chargers.

Other common aerial contaminants typically found inside an electrostatographic machine are particulates, including dusts and fibers. Thus, as is well known, aerially transported paper dust and paper fibers tend to be generated by operations involving the transport and manipulation of paper receiver sheets inside the machine. Airborne dust is also generally produced in the vicinity of toning stations, e.g., developer dust such as toner dust and carrier dust from a two-component developer, as well dusts such as silica dust and alumina dust commonly used for surface additives to toner particles. Dusts and fibers can be attracted to electrically charged bodies such as primary imaging member surfaces and corona chargers, and dusts and fibers also pose a threat to the integrity of image writers. Dusts and fibers on primary imaging member surfaces can cause serious image defects, e.g., by preventing uniform photodischarge or by adversely affecting toner transfer. Dusts and fibers can also deleteriously affect the performance of machinery or other mechanical apparatus used for operation of a printer. It is therefore desirable for all of the above reasons to filter dusts and fibers from the air used within an electrostatographic printer.

As is well known, fuser oils such as silicone oils are commonly used as release agents in fusing stations, and fuser oil volatiles that may be present in the air within an electrostatographic machine can cause significant harm to components, especially to corona chargers of the type which include thin high voltage wires for generating corona discharges. Silicone oil volatiles which reach such an operating corona charger can decompose on the thin high voltage wires, forming thereon deposits of silica which adversely affect charging performance. Fuser oil volatiles can also disadvantageously condense on various surfaces inside an electrostatographic machine, thereby producing sticky or gummy deposits which can be harmful to operation of the machine. Proper management or control of fuser oil volatiles is therefore desirable.

From the point of view of a customer using an electrostatographic printer, it is important to keep the mechanical noise pollution generated by the operation of the printer at comfortable levels for a customer using the printer, and in particular, air management noise pollution relating to airflow through ducts. Thus, in addition to legal requirements for environmental control of noxious gases such as ozone generated by an electrostatographic machine and emitted into the ambient air in the vicinity of the printer, management of noise pollution is also generally a requirement.

The prior art is now reviewed in relation to the various problems cited above associated with management or control of aerial environment within an electrostatographic machine.

Mechanical noise in an electrophotographic machine can be reduced or suppressed by the use of sound-deadening material, as disclosed in the Goodlander patent (U.S. Pat. No. 4,626,048). The noise associated with high speed airflows through ducts can be reduced or suppressed by the use of baffles in conjunction with sound-deadening material, as disclosed in the Hoffman et al. patent (U.S. Pat. No. 5,819,137).

Active control of dust in an electrophotographic machine has been disclosed. For example, the Tanaka et al. patent (U.S. Pat. No. 3,914,046) describes use of a suction device to remove scattered toner dust. A recirculation of air for controlling dust in the vicinity of a developer station is disclosed for example in the Kutsuwada et al. patent (U.S. Pat. No. 3,685,485). Dust filtered from air being recycled to imaging modules within a modular electrophotographic printer is described in the de Cock et al. patent (U.S. Pat. No. 5,481,339). Filtering of dust which is harmful in an ionographic machine is disclosed for example in the Nishikawa patent (U.S. Pat. No. 4,093,368) and in the Tanaka patent (U.S. Pat. No. 4,154,521). Dust control by means of vacuums, baffles and electrostatics is disclosed in the Gooray patent (U.S. Pat. No. 5,028,959). Filtering of dusts for air entering a printer and for air within a printer is described for example in the Suzuki et al. patent (U.S. Pat. No. 5,073,796) and the Hoffman et al. patent (U.S. Pat. No. 5,819,137). The Lotz patent (U.S. Pat. No. 5,056,331) discloses use of a positive pressure within a printer to repel dust external to the printer from entering the printer.

Control of ozone emitted from an electrophotographic machine has been disclosed for example in the Tanaka et al. patent (U.S. Pat. No. 3,914,046) and the Tanaka patent (U.S. Pat. No. 4,154,521) wherein a catalytic filter was used to form ordinary oxygen from the ozone, and also in the Suzuki et al. patent (U.S. Pat. No. 5,073,796). The Gooray patent (U.S. Pat. No. 5,028,959) discloses sucking ozone away from a primary charger by a tube leading to a filter at the exit of an electrophotographic copier. The Yamamoto et al. patent (U.S. Pat. No. 4,178,092) discloses blowing air to and sucking air away from a corona charger so as to remove noxious gases, and also discloses heating of a photoconductor to desorb corona-generated chemically active species. The Nishikawa patent (U.S. Pat. No. 4,093,368) describes a circulating flow of air within an electrostatographic ionography machine, such that ozone is continuously removed from the circulating flow of air by means of an ozone filter. The de Cock et al. patent (U.S. Pat. No. 5,481,339) and the Hoffman et al. patent (U.S. Pat. No. 5,819,137) both disclose ducting of ozone-containing air away from individual corona chargers in a printer.

The management of fuser oil volatiles typically emitted from a fusing station has been disclosed in the Gooray patent (U.S. Pat. No. 5,028,959) wherein a suction tube leading from a fusing station to a filter at the exit of an electrophotographic copier is disclosed. The Tsuchiya patent (U.S. Pat. No. 5,307,132) discloses venting of air drawn from the vicinity of a fusing station through a tube leading to the outside of an electrophotographic copier.

The Hoffman et al. patent (U.S. Pat. No. 5,819,137) discloses the use of a catalytic-type ozone filter included in an inlet filter for admitting ambient air from outside an electrophotographic printer to the interior of the electrophotographic printer, which ambient air may contain amines such as cyclohexylamine and which catalytic-type ozone filter reduces the amine concentration in the ambient air passing through the inlet filter. A system for detection of amines in ambient air and removal of the amines via a chemical filter is disclosed in the Kishkovich et al. patent (U.S. Pat. No. 6,096,267).

Cooling of electrophotographic apparatus by air moving devices such as fans or blowers has been described for example in the Tanaka et al. patent (U.S. Pat. No. 3,914,046), the Serita patent (U.S. Pat. No. 5,038,170), and the Hoffman et al. patent (U.S. Pat. No. 5,819,137). The Tsuchiya patent (U.S. Pat. No. 5,307,132) describes a heat discharging fan for removal of air from a fusing station. The de Cock et al. patent (U.S. Pat. No. 5,751,327) describes cooling of light-emitting diode (LED) devices in a printer, the LED devices connected in series in a closed cooling circuit utilizing a cooling fluid such as water.

Cooling of air recirculating within an electrophotographic apparatus is disclosed for example in the Suzuki et al. patent (U.S. Pat. No. 5,073,796), wherein the cooling is done by a Peltier effect device without admitting air from outside the apparatus. The Peltier effect device has an operationally cooled face and an operationally heated face, the circulating air being cooled by flowing past the cooled face, with heat from the heated face being conducted to fins for radiating the heat into the room in which the machine is housed. In an embodiment of the Suzuki et al. patent (U.S. Pat. No. 5,073,796), air is blown over the heated face of the Peltier effect device and the resulting heated air used for conditioning paper sheets in a paper conditioning unit included in the apparatus.

The Nishikawa et al. patent (U.S. Pat. No. 4,727,385) discloses management of relative humidity in an electrophotographic machine by a Peltier effect dehumidification/cooling device, the Peltier effect device having an operationally cooled face and an operationally heated face, whereby humid air is passed over the cooled face thereby cooling the humid air such that water can be removed from the humid air, after which the cooled dehumidified air may be passed over the heated face so as to reheat the dehumidified air. The Lotz patent (U.S. Pat. No. 5,056,331) discloses an air-conditioning unit attached to an electrophotographic machine, the air-conditioning unit for use for air-conditioning ambient air drawn into and passed through the electrophotographic machine without recycling, wherein the air-conditioning unit by its action produces a dehumidification of humid ambient air entering the machine, and wherein the dehumidification can be practiced in or out of combination with modification of air temperature. Control of relative humidity and temperature of air in an electrophotographic modular printer is disclosed in the de Cock et al. patent (U.S. Pat. No. 5,481,339), in which patent it is described how a first air-conditioned air having a controlled range of relative humidity and a controlled range of temperature can be delivered from an air-conditioning device included in the modular printer via piping connections to each imaging module included in the printer. Also, a second air-conditioned air having a relative humidity and temperature that may be different from that of the first air-conditioned air is provided for delivery to toning stations included in the modules. In the de Cock et al. patent (U.S. Pat. No. 5,481,339) both the first and second air-conditioned airs are recycled for reuse within the printer, and sensing devices for temperature and relative humidity are included for actively controlling temperature and relative humidity of air for recycling through the air-conditioning device. The Hamamichi et al. patent (U.S. Pat. No. 5,539,500) discloses use of a humidity sensor and a controller for controlling the relative humidity around image forming members in an electrophotographic machine, wherein excess humidity from humid ambient air drawn into the machine is removed by a cooling device, and humidification of dry ambient air drawn into the machine is provided by passing the dry air through a saturated membrane, and any air drawn into the machine is circulated therein and then emitted into the air outside the machine, i.e., not recycled for reuse.

Electrostatographic machines, in which a portion of the air within the machine is recycled for reuse, have advantages of localization of function, economy of means, and economy of air usage and energy usage. Thus, mechanisms for recirculation of air for filtering dust and ozone from the air within the general confines of an electrostatographic machine are for example disclosed in the Nishikawa patent (U.S. Pat. No. 4,093,368) and the Suzuki et al. patent (U.S. Pat. No. 5,073,796), both cited above. The above-cited Kutsuwada et al. patent (U.S. Pat. No. 3,685,485) describes recirculation of air in proximity to or included in a toning station, wherein developer particles scattered from the toning station are captured by a filter in a locally recirculating air stream associated with the toning station. The above-cited de Cock et al. patent (U.S. Pat. No. 5,481,339) teaches filtering of dust and ozone from air being recycled within modules of a modular electrophotographic printer, the air being moved from each module through separate pipes leading to an output manifold and thence through an appropriate dust filter and ozone filter, the resulting filtered air thereafter conditioned by an air-conditioning device and piped therefrom to an input manifold from which purified, conditioned air is piped back to each module. In the de Cock et al. patent (U.S. Pat. No. 5,481,339), the total flow rate of air-conditioned air is disclosed to be about 120 cubic meters per hour, or about 71 cubic feet per minute (cfm). This total flow of air-conditioned air is circulated through the modules of a printer, e.g., a modular electrophotographic printer in which there are typically 10 modules (5 modules disposed on either side of a continuous receiver sheet in the form of a moving web for duplex imaging).

On the other hand, an electrostatographic machine through which air is taken in and then expelled without recycling generally has an advantage that the overall interior of the machine or selected portions of the machine may be easily ventilated or cooled, as exemplified for example by the Lotz patent (U.S. Pat. No. 5,056,331), the Hamamichi et al. patent (U.S. Pat. No. 5,539,500), and the Hoffman et al. patent (U.S. Pat. No. 5,819,137). However, such apparatus is relatively inefficient in terms of energy usage, as compared to apparatus embodying recycling.

There remains a need for an overall approach to managing air quality within a modular electrostatographic color printing machine. Such an overall approach includes purification and air-conditioning of air for recycling and re-use in each imaging module, and also includes passing a differentiated flow of non-recycled air through the machine for removing excess heat and certain aerial contaminants generated by operation of the machine. To extend this overall approach, there is further need to provide an optimal RH and temperature for each of the modules in a modular electrostatographic printing machine, and also to provide individual RH and temperature control for certain subsystem devices included in the modules.

SUMMARY OF THE INVENTION

The invention is an air quality management apparatus for providing an overall air quality management of aerial environment in a modular electrostatographic printer, which printer is for making color images on receiver members. Overall air quality management includes management of levels of aerial contaminations such as for example particulates, ozone, amines, acrolein that may be present within the printer. Overall air quality management also includes providing air-conditioned air to certain interior volumes within the printer, which air-conditioned air has controlled temperature and relative humidity.

An object of the invention is to provide to the individual image-forming modules, and to certain subsystem devices included in the modules, streams of air-conditioned air for subsequent recycling through an air-conditioning device included in the air quality management apparatus, the air-conditioned air being conditioned so as to have suitable temperature and relative humidity as may be required.

Another object of the invention is to provide, to auxiliary chambers associated with the image-forming modules, other air-conditioned air flows for subsequent recycling through the air-conditioning device, which other air-conditioned air flows are separated from the streams of air-conditioned air for use in the modules. The auxiliary chambers include electrical and mechanical equipment for operating the modules, which electrical and mechanical equipment are required to operate in a controlled temperature range.

Yet another object of the invention is to provide a management of non-air-conditioned air quality of air, which non-air-conditioned air is not provided to the modules nor to the auxiliary chambers, and which air is flowed at a high throughput rate through certain other portions of the printer, including a fusing station and optionally a paper conditioning station.

Thus the invention provides air quality management apparatus which separates certain contamination streams from other streams, and also separates air-conditioned streams (for use with imaging components of the printer) from non-air-conditioned streams (for use with non-imaging components of the printer).

The air quality management apparatus includes a non-air-conditioned open-loop portion through which ambient air is drawn from outside the printer, and a recirculation portion for both air purification and air-conditioning. The printer, for making color images on receiver members, has a first interior volume and a second interior volume. The open-loop portion manages air quality of air passing proximate to a fusing station for fusing the color images on the receiver members, and optionally manages air quality of air moved past a paper conditioning station which may be included in the printer. The second interior volume includes a number of tandemly arranged image-forming modules, the modules having associated devices such as charging devices, image writers, toning stations and cleaning stations. The second interior volume is differentiated from the first interior volume by at least one separating member. The open-loop portion is for managing the quality of air in the first interior volume, and the recirculation portion for managing the quality of air in the second interior volume. In the open-loop portion, designed to remove excess heat and aerial contamination generated within the first interior volume, ambient air is flowed through at least one inlet port and through a plurality of throughput pathways included within the first interior volume to at least one outlet port, the open-loop portion including at least one air moving device for providing a specified total airflow rate. The recirculation portion of the air quality management apparatus includes an air-conditioning device for controlling temperature and relative humidity of air included in the second interior volume. The air-conditioning device has at least one entrance and at least one exit, each exit providing a post-exit airflow which may be subdivided into post-exit subflows which may be individually air-conditioned. Certain ones of the post-exit airflows are piped to corresponding image-forming modules for use therein. The recirculation portion of the air quality management apparatus further includes at least one air recirculation device for moving air included in the second interior volume at a specified total rate of recirculation through the air-conditioning device, such that the post-exit airflows are urged through a plurality of recirculation pathways and from thence to a filtering unit located proximate to the entrance to the air-conditioning device, the filtering unit designed to continuously remove particulates, ozone, and amines from air in the second interior volume.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Figure 1A:
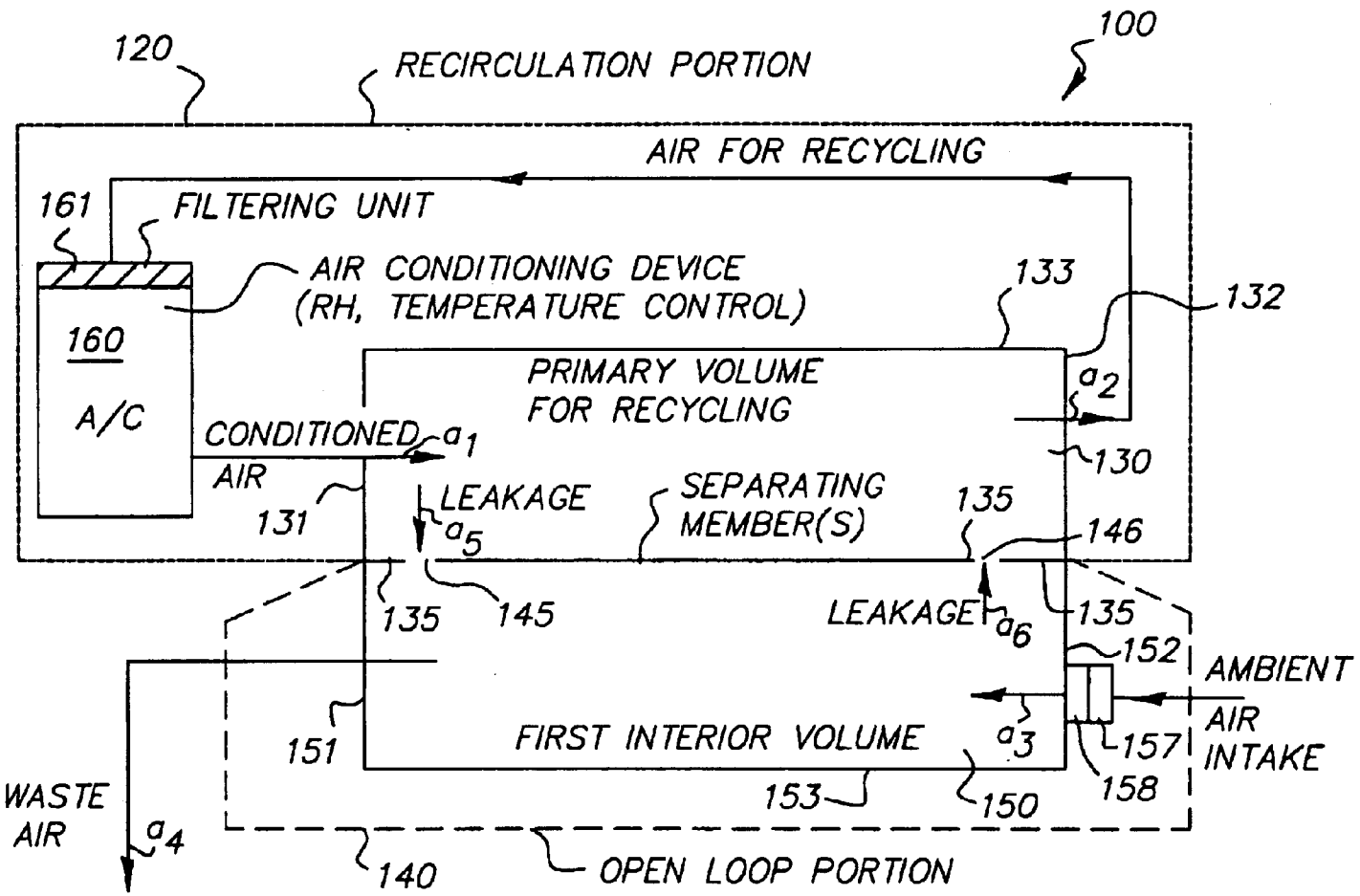
FIG. 1A schematically depicts a block diagram of an air quality management apparatus of the invention, which air quality management apparatus includes two portions: an open-loop portion, and a recirculation portion wherein air is air-conditioned for recirculation and filtered by a filtering unit.

The invention is an air quality management apparatus for inclusion in a modular electrostatographic color printer for making color images on receiver members, which electrostatographic color printer may be an electrophotographic color printer or an electrographic color printer. The exemplary modular color printer for use with the invention includes a number of tandemly arranged electrostatographic imaging-forming modules (see for example U.S. Pat. No. 6,184,911). In each module a toner image is electrostatically transferred from a respective moving primary image-forming member, e.g., a photoconductor, to a moving intermediate transfer member, which toner image, e.g., a single-color toner image, is then electrostatically transferred from the intermediate transfer member to a moving receiver member. The receiver member is moved progressively through the imaging-forming modules, wherein in each successive module the respective toner image is transferred from the respective primary image-forming member to a respective intermediate transfer member and from thence to the moving receiver member, the respective single-color toner images being successively laid down one upon the other on the receiver member so as to complete, in the last of the modules, a full-color toner image, e.g., a four-color toner image, which receiver is then moved to a fusing station wherein the full-color toner image is fused to the receiver. Alternatively, the respective toner images formed in respective modules may be transferred atop one another to form a composite full-color toner image on the intermediate transfer member, which composite image is subsequently transferred to the receiver member and the receiver then moved to a fusing station where the composite image is fused to the receiver. As another alternative, the respective toner image is electrostatically transferred from a respective moving primary image-forming member directly to a moving receiver member, such that a full-color image is sequentially built up in successive modules. As yet another alternative, the various image-forming modules may be disposed around a primary imaging member upon which a full-color composite toner image may be created for subsequent transfer of the composite image from the primary imaging member to a receiver. Typically, colored toners for use in the above-described apparatus are typically included in a 4-color set tailored for color imaging. However, as is known, certain modules may employ other toners, such as specialty color toners or clear toners.

The electrostatographic color printer for use with the air quality management apparatus of the invention includes a first interior volume and a second interior volume, the second interior volume being differentiated from the first interior volume by at least one separating member.

Air quality of air in the first interior volume is managed by an open-loop portion of the air quality management apparatus, wherein ambient air is drawn through the first interior volume and expelled from the printer, preferably to a collection device for waste air. The first interior volume includes a fusing station for fusing color toner images on the receiver members, and optionally includes a paper conditioning station for conditioning paper receivers.

Air quality of air in the second interior volume is managed by a recirculation portion of the air quality management apparatus, which recirculation portion includes apparatus for controllably flowing conditioned air through the second interior volume so as to maintain temperature and relative humidity of air therein within predetermined ranges, the conditioned air being recirculated through the second interior volume for continuous recycling. Provision may be made for flowing more than one individually air-conditioned air stream to different locations for use therein. The second interior volume includes for example a number of tandemly arranged electrophotographic image-forming modules having associated devices operating in conjunction with the image-forming modules, which associated devices include charging devices such as corona charging devices, image writers, toning stations, and cleaning stations. Typically, four or more image-forming modules are used.

A feature of the invention is to keep contamination streams isolated, with aerial contaminations captured at points of generation.

With reference to the accompanying figures, FIG. 1A shows a generic diagram of an air quality management apparatus of the invention, indicated by the numeral 100. This generic diagram is used as a reference diagram for describing various embodiments of the invention, and terminology introduced for explaining FIG. 1A has similar usage in the disclosure following. A dashed line labeled 140 schematically indicates an open-loop portion of the air quality management apparatus of the invention, and a dotted line labeled 120 schematically indicates a recirculation portion of the air quality management apparatus. The open-loop portion 140 is for managing air quality in the first interior volume 150. The recirculation portion 120 is for managing air quality of air contained both in a primary volume for recycling 130 (henceforth volume 130) and in an air-conditioning device 160. The second interior volume encompasses the volume 130 as well as any other volume that contains air for recycling through the air-conditioning device 160, including air for recycling passing through a duct or ducts (not shown) connecting the air-conditioning device and the volume 130. Included in the recirculation portion 120 is at least one mechanism for removing aerial contaminants from the air for recycling. The air-conditioning device 160, indicated by A/C, includes at least one exit (not separately shown) and provides air-conditioned air for circulation by at least one air recirculation device (not shown) through the volume 130. Air-conditioned air, flowing as indicated by an arrow labeled $a_1$, is piped from air-conditioning device 160 into the volume 130 through a wall 131 via at least one entry (not shown) and subsequently moved through a plurality of recirculation pathways (not shown) included in volume 130. A corresponding flow of air for recycling, indicated by an arrow labeled $a_2$, is piped out of volume 130 and leaves through a wall 132 via at least one port (not shown). The air for recycling is then returned via suitable ductage to the air-conditioning device after first passing through a filtering unit 161, which filtering unit removes aerial contaminants from the air for recycling, which aerial contaminants may include for example particulates, ozone and amines. The airflow indicated by arrow $a_1$ includes one or more post-exit airflows leaving the air-conditioning device 160.

Figure 1B:
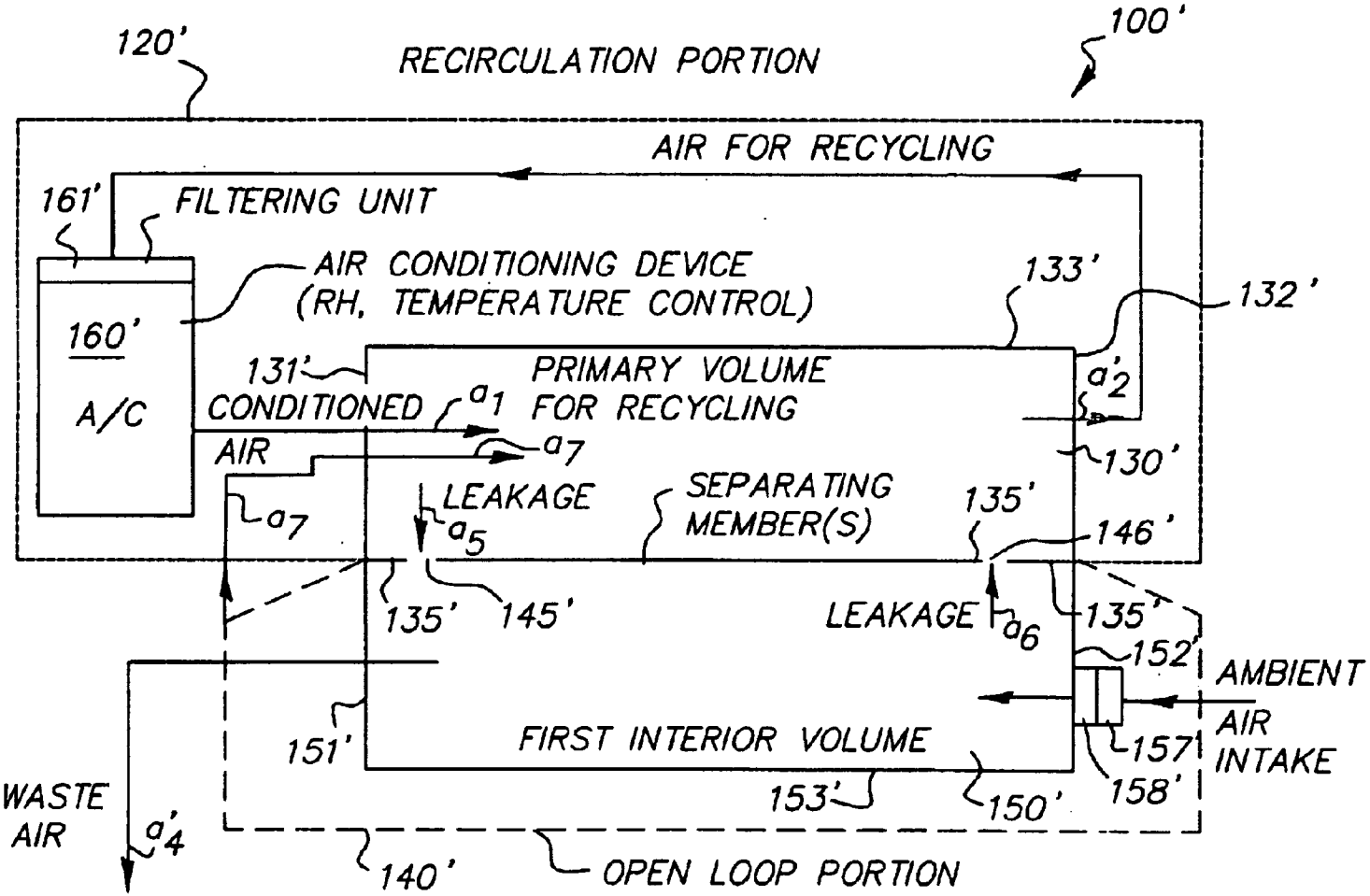
FIG. 1B shows apparatus of FIG. 1A further including an inlet into the recirculation portion and an optional outlet therefrom, which inlet is for an airflow of ambient air to be drawn into the recirculation portion and which optional outlet is for a corresponding airflow to be expelled from the recirculation portion.
Figure 1C:
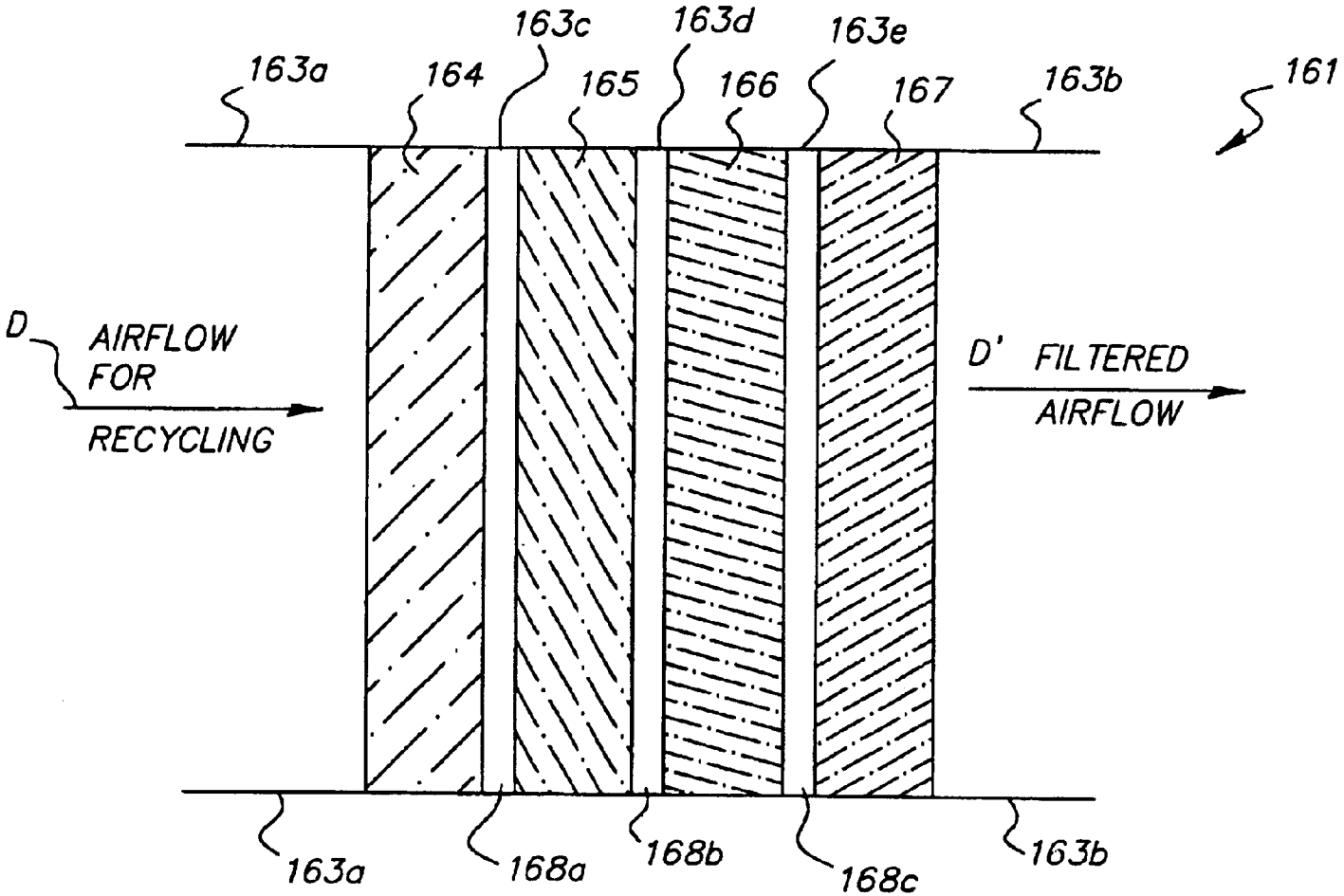
FIG. 1C schematically shows an embodiment of the filtering unit of FIG. 1A in side elevational view.

An exemplary filtering unit 161, for use in apparatus 100, is illustrated schematically in FIG. 1C. Airflow for recycling (corresponding to airflow of arrow $a_2$ in FIG. 1A) is indicated by arrow D shown directed toward filtering unit 161, which filtering unit includes an entry duct 163*a*. An exit duct 163*b*, connecting to unit 160, carries filtered air as indicated by arrow D'. Included in the filtering unit 161, in order of passage of air for filtering, is a particulate filter 164 for removing coarse particles from airflow D, a particulate filter 165 for removing fine particles, an ozone filter 166 for absorbing or decomposing ozone, and an amine filter 167 for absorbing or decomposing amine contaminants. The filters 164, 165, 166 and 167 are mounted within suitable ductwork, i.e., for connecting the entry duct 163*a* and the exit duct 163*b*. Short sections of duct, shown as 163*c*, 163*d*, and 163*e*, provide suitable spacings shown as 168*a*, 168*b*, and 168*c* between successive filters, each such spacing typically having a length of the order of 3 millimeters. It will be understood that the filtering unit 161 may not include all four filters 164, 165, 166 and 167. However, filtering unit 161 preferably includes filters for removing coarse and fine particulates. Furthermore, it will also be understood that fewer than four or more than four filters may be used in unit 161, and that any filter providing functional removal of any objectionable contaminant may be included, as may be necessary, for purification of air being recycled in the recirculation portion of the air quality management apparatus 100.

In certain embodiments, air-conditioned air included in airflow $a_1$ has substantially the same characteristics of temperature and relative humidity in each of the one or more post-exit airflows, while in other embodiments at least two post-exit airflows have differing characteristics of temperature, relative humidity, or both temperature and relative humidity.

In yet other embodiments disclosed below of an air quality management apparatus of the invention, one or both of a third interior volume and a fourth interior volume are included in addition to the first and second interior volumes, which third and fourth interior volumes do not overlap the first interior volume and the second interior volume (third and fourth interior volumes not illustrated in FIG. 1A).

The air-conditioning device 160 is provided with temperature sensors (not shown) for sensing air temperatures of the one or more post-exit airflows, these air temperatures being electronically relayed as temperature information to a temperature controller (not shown), the temperature controller for controlling air temperatures of the one or more post-exit airflows by means of suitable temperature controlling mechanisms. Similarly, the air-conditioning device 160 is provided with relative humidity sensors (not shown) for sensing relative humidities of the one or more post-exit airflows, these relative humidities being electronically relayed as relative humidity information to a relative humidity controller (not shown), the relative humidity controller for controlling relative humidities of the one or more post-exit airflows by means of suitable relative humidity controlling mechanisms. Airflow rates corresponding to arrows $a_1$ and $a_2$ are substantially equal, and are determined by a specified total rate of recirculation of air included in the second interior volume. In addition to walls 131 and 132, the volume 130 is further defined by a wall 133 and also by the at least one separating member, labeled 135. Walls 131, 132, 133, the at least one separating member 135, and other walls (not shown) together form an enclosure of the volume 130. Similarly, an enclosure of the first interior volume is defined by walls 151, 152, 153, the at least one separating member 135, and by yet other walls (not shown). The at least one separating member is common to the enclosures of both the first interior volume 150 and the volume 130.

The open-loop portion 140 provides an intake flow of ambient air from outside the printer, as indicated by the arrow $a_3$, as well as an outflow of expelled air, as indicated by the arrow $a_4$, which outflow is waste air for disposal at a location outside of the printer, and which location preferably does not include the environs of ambient air surrounding the exterior of the printer. The waste air carries out of the printer aerial contamination and excess heat generated within volume 150. Preferably, the outflow $a_4$ is sent to an external mechanism for air disposal within the building in which the printer is housed, which external mechanism for air disposal may be a Heating, Ventilation, or Air Conditioning system (HVAC system) typically provided for a building as a whole. The intake flow as indicated by the arrow $a_3$ passes through at least one inlet port (not shown) located in wall 152, while the corresponding substantially equal outflow $a_4$ passes through at least one outlet port (not shown) located in wall 151. Each of the intake flow rate and the outflow flow rate is substantially equal to a specified total airflow rate through the first interior volume 150. Airflow through the first interior volume 150 is provided by at least one air moving device (not shown) which causes air to flow from the at least one inlet port to the at least one outlet port through a plurality of throughput pathways (not illustrated, included in volume 150). Apart from the at least one inlet port for the intake flow to the first interior volume and the at least one outlet port from the first interior volume, it is preferred that the enclosures for the first interior volume and the volume 130 are substantially sealed from the ambient air surrounding the printer.

Each inlet port to volume 150 is preferably provided with an inlet port filter for removing airborne particles from ambient air entering the first interior volume. The inlet port filter 157 is preferably a high throughput filter similar to a commercial residential furnace filter available for example from the Fedder Corporation or from the Grainger Corporation (e.g., Grainger Model 5C460). An optional amine filter 158 specifically designed for removal of amines from ambient air entering the first interior volume may be used in conjunction with the filter for removing airborne particles.

The at least one separating member 135 may be associated with multiple leakage pathways, schematically indicated as 145 and 146. The leakage pathways 145 and 146 may be located anywhere along the length of the at least one separating member 135. Passing through one or more such leakage pathways 145 into the first interior volume 150 from the volume 130 (the primary volume for recycling 130 being included in the second interior volume) are one or more air leakage flows as indicated by arrow $a_5$. Similarly, passing from the first interior volume into the volume 130 through one or more leakage pathways 146 are one or more leakage airflows as indicated by arrow $a_6$. A total leakage airflow rate as indicated by arrow $a_5$ is substantially equal to a total leakage airflow rate as indicated by arrow $a_6$. The leakage airflow rate indicated by arrow $a_5$ is a predetermined fraction of the specified total rate of recirculation. Preferably, the predetermined fraction of the specified total rate of recirculation is less than 0.33, which predetermined fraction in certain apparatus may include substantially zero.

There will in general be a drop in air pressure between a location just inside wall 131 within the volume 130 and another location just inside wall 132, which drop in air pressure is associated with the specified total rate of recirculation of air flowing through the volume 130. Similarly, there will generally be another drop in air pressure between a location just inside wall 152 within the first interior volume 150 and another location just inside wall 151, this other drop in air pressure being associated with the specified total airflow rate of air flowing through the first interior volume. Typically, the air pressure just inside wall 131 is higher than just inside wall 151, and the air pressure just inside wall 152 is higher than just inside wall 132, corresponding to the directions of arrows $a_5$ and $a_6$ as illustrated for the general case when leakages $a_5$ and $a_6$ are non-negligible. In addition, the one or more leakage pathways 145 and 146 may not be localized, and may instead be distributed along the length of the at least one separating member 135, whereupon leakage flow rates corresponding to such a distributed leakage flow pattern will depend on the positions of the associated one or more leakage pathways 145 and 146. In a case of such a distributed leakage as described above, there will generally be a location in the distributed leakage flow pattern where the net local leakage flow between volumes 130 and 150 is substantially zero.

An alternative embodiment of the air quality management apparatus of the invention is shown in FIG. 1B, in which primed (') entities are entirely similar to corresponding unprimed entities in FIG. 1A. Filtered air from outside of the printer is drawn at a prespecified input rate as indicated by arrow $a_7$ directly into volume 130' through appropriate input pipes (not shown). Preferably, the prespecified input rate divided by the total recirculation rate is less than about 0.2, and more preferably, less than about 0.05. An output rate of airflow from the second interior volume, substantially equal to the input rate from outside of the printer, may be transmitted from the second interior volume into the first interior volume so as to join the outflow therefrom, or alternatively may be directly expelled through an optional outlet from the second interior volume, as indicated by arrow $a_8$, to a location outside the printer through appropriate output pipes (not shown). Such an equivalent output rate of airflow expelled from the second interior volume to a location outside the printer is necessary when the above-mentioned predetermined fraction of the specified total rate of recirculation is substantially zero and leakages such as $a_5$ and $a_6$ are substantially absent, i.e., when the at least one separation member effectively seals the second interior volume from the first interior volume. If desired, an airflow $a_8$ may be combined for disposal with airflow $a_4$' via appropriate ductage (not shown). A purpose for flowing filtered ambient air at a prespecified input rate from outside of the printer through the second interior volume is to refresh the atmosphere within the second interior volume, for example on account of changes in air composition resulting from usage of corona devices included in the second interior volume, especially in apparatus in which leakages such as $a_5$ and $a_6$ are substantially absent.

Figure 2:
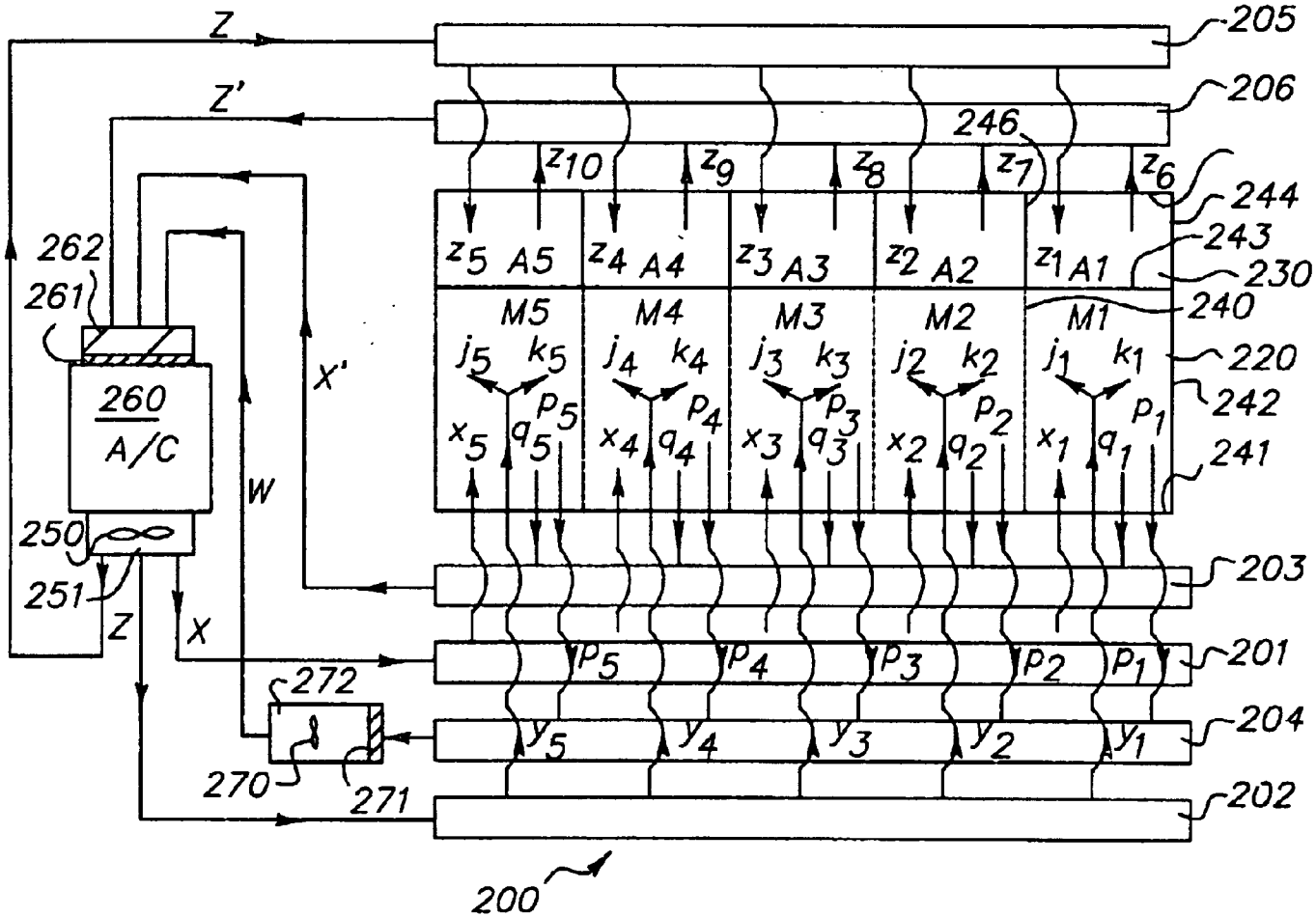
FIG. 2 diagrammatically depicts airflow pathways located within a recirculation portion of an air quality management apparatus of the invention, which air quality management apparatus is for use in a modular color printing machine including a number of electrostatographic imaging modules, the airflow pathways leading to and from the modules and to and from associated components and auxiliary chambers associated with the modules.

FIG. 2 shows an exemplary schematic airflow diagram for air circulated within a second interior volume by a recirculating portion of an air quality management apparatus of the invention, the recirculating portion indicated by the numeral 200. Five image-forming modules, included in the second interior volume, are indicated as M1, M2, M3, M4 and M5, although a smaller or a greater number of modules may be employed in the printer. Each image-forming module is associated with an individual toner for inclusion in a full-color toner image, the full-color toner image being built up successively from module to module. Generally, four of the five modules are used for creating individual color toner images for transfer to a receiver member, which individual color toner images typically include a cyan toner image from a cyan toner module, a magenta toner image from a magenta toner module, a yellow toner image from a yellow toner module and a black toner image from a black toner module, with all such individual color toner images being included in the full-color toner image transferred to the receiver member. The fifth module can be used for making images with a specialty toner, e.g., a specialty color toner for making logo images. Alternatively, the fifth module may be used for creating a colorless or clear toner layer or image. As another alternative, six modules may be used so as to include both a specialty color toner module and a clear toner module, or a larger number of modules may be used which may include specialty toners or clear toners. To fit a certain application, any suitable sequential order of the modules may be used.

Image-forming module M1, for creating for example a first toner image of a full-color image, is included in a volume 220 delineated by lines 241, 242, and 243. The dotted line 240 indicates a division between module M1 and module M2, which division may represent a partial wall, or no wall. The other image-forming modules are located in similarly delineated volumes. Respectively associated with modules M1, M2, M3, M4 and M5 are corresponding auxiliary chambers A1, A2, A3, A4 and A5. Each of the auxiliary chambers contains heat generating devices for operating the respective module, which heat generating devices include: drive motors, e.g., for rotating rotatable members such as drums or rotatable webs included in the modules, power supplies, circuit boards, and the like. Auxiliary chamber A1, denoted as 230, is bounded in FIG. 2 by the lines 243, 244, 245 and 246, with similar boundaries for the other auxiliary chambers. The boundary line 243 represents a common wall separating the volume 220 and the auxiliary chamber A1, and similarly for the other adjacent auxiliary chambers. Rotating drive axles (not shown) can pass through openings (not shown) in walls such as wall 243, which axles connect drive motors located inside the auxiliary chambers with rotatable drums or rotatable webs included in corresponding modules, and which openings are preferably provided with seals around the axles for maintaining effective isolation of the auxiliary chambers from the modules. Similarly, it is preferred that conduits are provided for carrying electrical wires between the auxiliary chambers and the modules, which conduits are preferably provided with seals as the conduits pass through walls such as wall 243, the seals maintaining effective isolation of the auxiliary chambers from the modules. Each of the boundaries between adjacent auxiliary chambers, e.g., boundary 246, may be a complete wall, or it may be a partial wall for allowing some air flow between auxiliary chambers.

An air-conditioning device 260 and an input filtering unit 261 shown in FIG. 2 have functions similar to those of the entities 160 and 161 of FIG. 1. A main air recirculation device indicated as 250 provides primary impetus for circulation of air within the recirculating portion 200 of the air quality management apparatus. The main air recirculation device, located in a housing 251, is chosen from a group including blowers, fans, air suction mechanisms, and the like. Air-conditioned air is moved by the main air recirculation device 250 through housing 251 for division into three airflows, which airflows are respectively indicated by arrows X, Y, and Z, the airflows flowing in the directions indicated by the arrows. Each of the airflows X, Y, and Z is a percentage of the airflow leaving the exit of the air-conditioning device 260, the percentages being determined by the respective airflow impedances. The sum of the airflow rates corresponding to X+Y+Z is equal to the specified total rate of recirculation of air included in the second interior volume. Although main air circulation device 250 is shown attached externally via plenum 251 to air-conditioning device 260, it is to be understood that device 250 may instead be located within device 260 or alternatively be located separately from device 260.

Airflow X provides module-ventilating air-conditioned air which is piped to a module-supplying input manifold 201, which module-supplying input manifold is provided with output pipes through which airflow X is delivered in approximately equal module-ventilating flows to the respective air volumes (e.g., volume 220) which respective air volumes include the individual modules M1, M2, M3, M4, and M5. These approximately equal module-ventilating flows, indicated by corresponding arrows $x_1$, $x_2$, $x_3$, $x_4$, and $x_5$, provide air-conditioned air for bathing each of the modules. Respective module-exhausting outflows indicated by arrows $q_1$, $q_2$, $q_3$, $q_4$ and $q_5$ are led via respective exhaust pipes away from each of the respective air volumes to a module-exhausting output manifold 203, from which module-exhausting output manifold an air stream X' for recycling returns via ductage to the filtering unit 261.

Airflow Y provides air-conditioned air directly to certain subsystems included in the modules M1, M2, M3, M4, and M5. Thus airflow Y is piped to a subsystem-supplying input manifold 202 from which approximately equal amounts of subsystem-ventilating air-conditioned air, indicated by arrows $y_1$, $y_2$, $y_3$, $y_4$, and $y_5$ are delivered as subsystem flows to the modules M1, M2, M3, M4, and M5. For example, each such subsystem flow can include an image-writer-related portion of flow and a charger-related portion of flow. Each image-writer-related portion is delivered for cooling a respective image writer in each module (image writers not shown), while each charger-related portion is delivered for ventilating one or more charging devices, e.g., corona chargers, in each module (charging devices not shown). Thus the subsystem flow $y_1$ is shown divided (by appropriate ductage) into separate flows, i.e., $j_1$ which is an image-writer-related flow and $k_1$ which is a charger-related flow. The flow $j_1$ is for cooling an image writer in module M1, and the flow $k_1$ is for corona charger ventilation, e.g., for ventilating a primary charger used for sensitizing a photoconductive primary image-forming member (not shown) in module M1. The other subsystem flows are similarly subdivided in the remaining modules, as illustrated. Alternatively, the image-writer-related flows and the charger-related flows can each be piped directly from the subsystem-supplying input manifold 202 to the respective subsystem locations. A respective image writer, such as used for exposing a respective photoconductive primary image-forming member in a respective module, may include for example a laser array or an LED array. The respective image writer is preferably provided with cooling fins, with the respective image writer thereby cooled by the respective image-writer-related portion of flow, e.g., $j_1$, of air-conditioned air flowing past these cooling fins.

The image-writer-related portions $j_1$, $j_2$, $j_3$, $j_4$, and $j_5$ which are used for cooling the image writers are respectively returned for recycling by inclusion with the respective module-exhausting outflows $q_1$, $q_2$, $q_3$, $q_4$, and $q_5$, i.e., thereby included in the flow X'. Alternatively, separate ductage (not specifically illustrated in FIG. 2) may be provided for returning these image-writer-related portions to the filtering unit 261, either separately or jointly.

The charger-related portions $k_1$, $k_2$, $k_3$, $k_4$, and $k_5$ (which may be used for ventilating certain ones, e.g., primary chargers, of the charging devices included in the modules) are respectively returned for recycling by inclusion with the module-exhausting outflows $q_1$, $q_2$, $q_3$, $q_4$, and $q_5$, i.e., thereby included in the flow X'. Similarly ozone, generated for example by charging devices such as corona charging devices in each of the modules, is correspondingly entrained in the module-exhausting outflows $q_1$, $q_2$, $q_3$, $q_4$, and $q_5$ and thence returned to the filtering unit 261, i.e., included within the flow X'. Alternatively, separate ductage (not specifically illustrated in FIG. 2) may be provided for returning ozone-laden air to the filtering unit 261, which ductage may have connection directly to an interior of any of the charging devices included in modules M1, M2, M3, M4, and M5, or which ductage may provide ozone extraction from the vicinity of any such corona charging device.

Other ductage (not shown) carries particulate-laden air away from toning stations and cleaning stations included in the modules (toning stations and cleaning stations not shown). Thus, in associative proximity with each such toning station is a respective developer-dust-removal duct for carrying away developer particles thrown from the respective toning station into the air near the toning station. As is well known, developer particles may include carrier particles, toner particles, or other particles such as particles of silica, titania, and the like. Also, in associative proximity with each such cleaning station is a respective cleaning-station-debris-removal duct for carrying away particulate debris produced in air near the respective cleaning station. Such a cleaning station may be used for cleaning a primary imaging member or for cleaning an intermediate transfer member (primary imaging members and intermediate transfer members not shown). In FIG. 2 are shown outflows $p_1$, $p_2$, $p_3$, $p_4$, and $p_5$ from modules M1, M2, M3, M4, and M5, respectively, which outflows $p_1$, $p_2$, $p_3$, $p_4$, and $p_5$ carry both developer dust and cleaning station debris away from the respective modules to a particulate-related output manifold, 204. Thus, each of the outflows $p_1$, $p_2$, $p_3$, $p_4$, and $p_5$ combines a toning-station-related airflow and cleaning-station-related airflow to the particulate-related output manifold, 204. From the particulate-related output manifold 204, air carrying entrained developer dust and cleaning station debris is transported to filtering unit 261 as a flow W for recycling, with flow W previously passing through an optional auxiliary filter 271. Optional auxiliary filter 271 acts as a combined auxiliary developer dust filter and auxiliary cleaning station debris filter. In order to overcome a locally increased impedance to airflow created by optional auxiliary filter 271, an auxiliary air moving device 270, e.g., a suction device, is provided located in housing 272.

It is to be understood that separate ductages (not specifically illustrated in FIG. 2) may be provided for transporting developer-dust-laden air from the respective toning stations to a particulate-related output manifold for collecting the developer-dust-laden air and from thence to the optional auxiliary filter 271, and for transporting cleaning-station-debris-laden air from the respective cleaning stations to a particulate-related output manifold for collecting the cleaning-station-debris-laden air and from thence to optional auxiliary filter 271 or to separate auxiliary filters (not shown) which may be used in conjunction with such separate ductages. It is further to be understood (though not illustrated) that each module M1, M2, M3, M4, and M5 may be provided with a respective auxiliary developer dust filter and a respective auxiliary cleaning station debris filter, which respective auxiliary developer dust filter and respective auxiliary cleaning station debris filter may be separate filters or which may be combined into a single respective auxiliary filter for each module, with auxiliary air moving devices being appropriately provided for each such auxiliary filter and appropriate ductage also being appropriately provided downstream from these filters and connecting to plenum 262.

Air-conditioned airflow Z provides auxiliary-chamber-ventilating air for ventilation of the auxiliary chambers A1, A2, A3, A4, and A5, which auxiliary-chamber-ventilating air is piped to an input manifold for ventilation 205. Ventilation of the auxiliary chambers has as a primary purpose a removal of heat emitted by heat-generating devices within the auxiliary chambers. Such heat-generating devices include: mechanical devices, power supplies, motors, electrical equipment, electrical circuit boards, and the like. It is important to remove this excess heat so as to for example keep mechanical tolerances, which are typically sensitive to thermal expansion, within desired operating limits. Ventilation of the auxiliary chambers has as a secondary purpose a removal of contaminants that may be generated within the auxiliary chambers, such as for example water vapor, particulates, ozone (emitted from electrical motors), oxides of nitrogen (emitted from electrical motors), and amines (possibly emitted from plastic components). Within input manifold for ventilation 205 the airflow Z is divided into approximately equal auxiliary-chamber-input airflows, i.e., $z_1$, $z_2$, $z_3$, $z_4$ and $z_5$, for respectively ventilating the corresponding auxiliary chambers with air-conditioned air. After flowing through the auxiliary chambers, air is returned for recycling via corresponding respective auxiliary-chamber-exhausting airflows $z_6$, $z_7$, $z_8$, $z_9$ and $z_{10}$, the auxiliary-chamber-exhausting airflows flowing to an auxiliary-chamber-exhausting output manifold, 206, whereupon a flow Z' for recycling returns air leaving manifold 206 to the filtering unit 261. Filtering unit 261 removes for example particulates, ozone, and amines generated within the auxiliary chambers and carried therefrom by the flow Z'.

The filtering unit 261 generally includes a plurality of filters arranged in a predetermined order in the direction of the flows X', W and Z'. Preferably, this plurality of filters includes filters similar to the filters of filtering unit 161 of FIG. 1A, i.e., unit 261 typically includes at least a coarse particulate filter and a fine particulate filter, and may further include other filters such as for example an ozone filter and an amine filter, listed in order of passage of air for recycling coming from plenum 262.

Figure 3A:
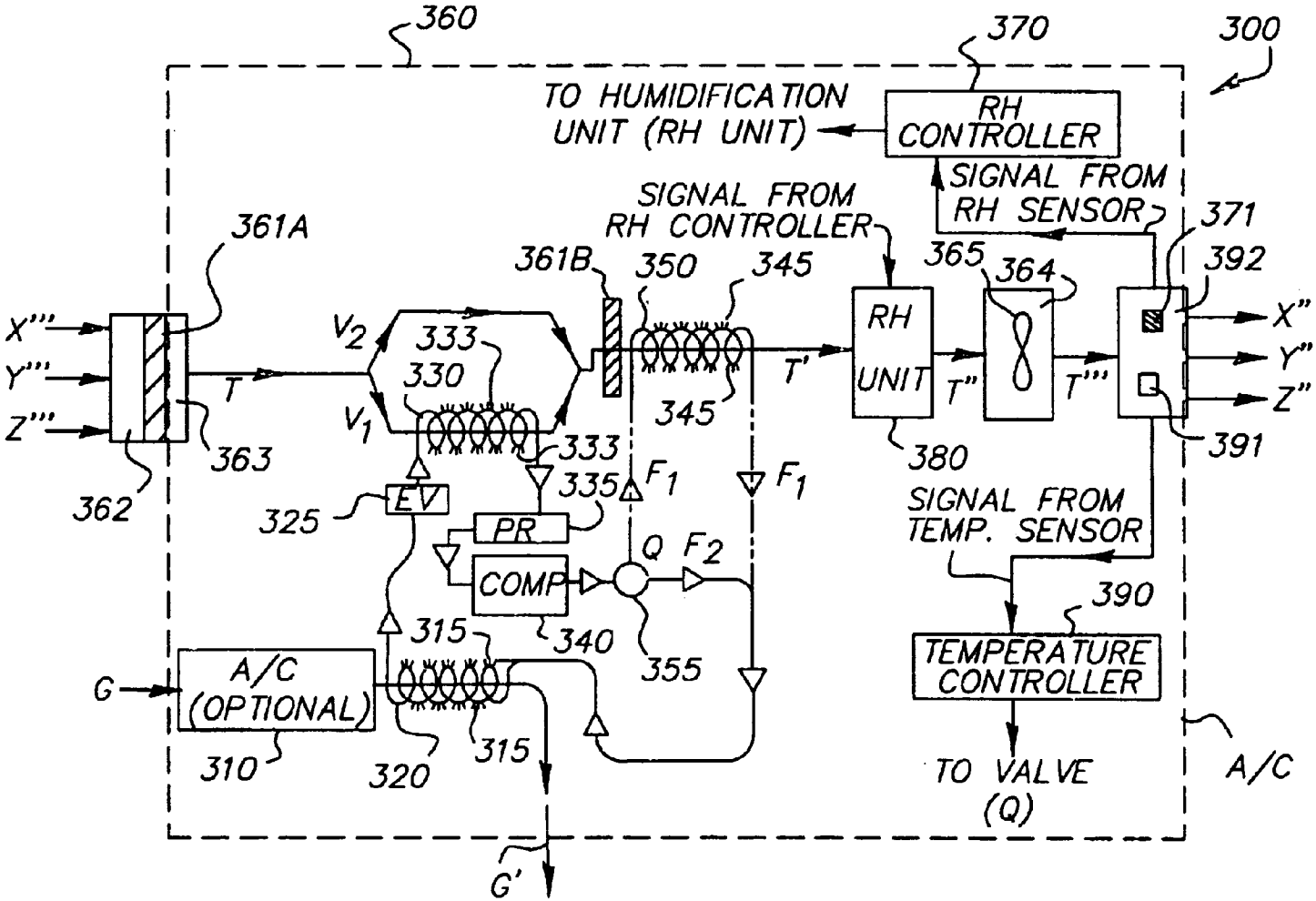
FIG. 3A schematically illustrates a preferred embodiment of an air-conditioning device for use in the air quality management apparatus of the invention.

A preferred embodiment of an air-conditioning device, for use in the recirculation portion of the air quality management apparatus of the invention, is shown as 300 in FIG. 3A. The dashed line 360, labeled A/C, encloses the working portion of the air-conditioning device (corresponding to items 160 and 260 of FIGS. 1A and 2 respectively). Directions of flows of air passing through working portion 360 are indicated by solid arrowheads, while open arrowheads are used to indicate directions of flow of a refrigerant inside a closed system of pipes within the air-conditioning device. Thus, airflows X", Y" and Z" of air-conditioned air are shown exiting a plenum 364, the airflows X", Y" and Z" being moved out of the air-conditioning device 360 by main air recirculation device 365 housed in plenum 364 (device 365 corresponds to device 250 of FIG. 2). The three airflows X", Y" and Z" can respectively correspond to the three airflows X, Y and Z of FIG. 2, although a different number of air-conditioned airflows may be provided leaving plenum 364, as may be needed in a particular application. Similarly, air for recycling is shown returning as flows X'", Y'" and Z'" to the air-conditioning device for entry into plenum 362. The three flows X'", Y'" and Z'" can respectively correspond to the three airflows X', W and Z' of FIG. 2, although a different number of incoming airflows for recycling may be provided entering plenum 362, as may be needed. The incoming airflows pass through filtering unit 361A, which filtering unit includes a coarse particulate filter and a fine particulate filter, described in detail below. Plenum 362 and filtering unit 361A may alternatively be included in A/C. After filtering by unit 361, the incoming airflows are combined in a mixing chamber 363 into a single airflow, labeled T.

Figure 3B:
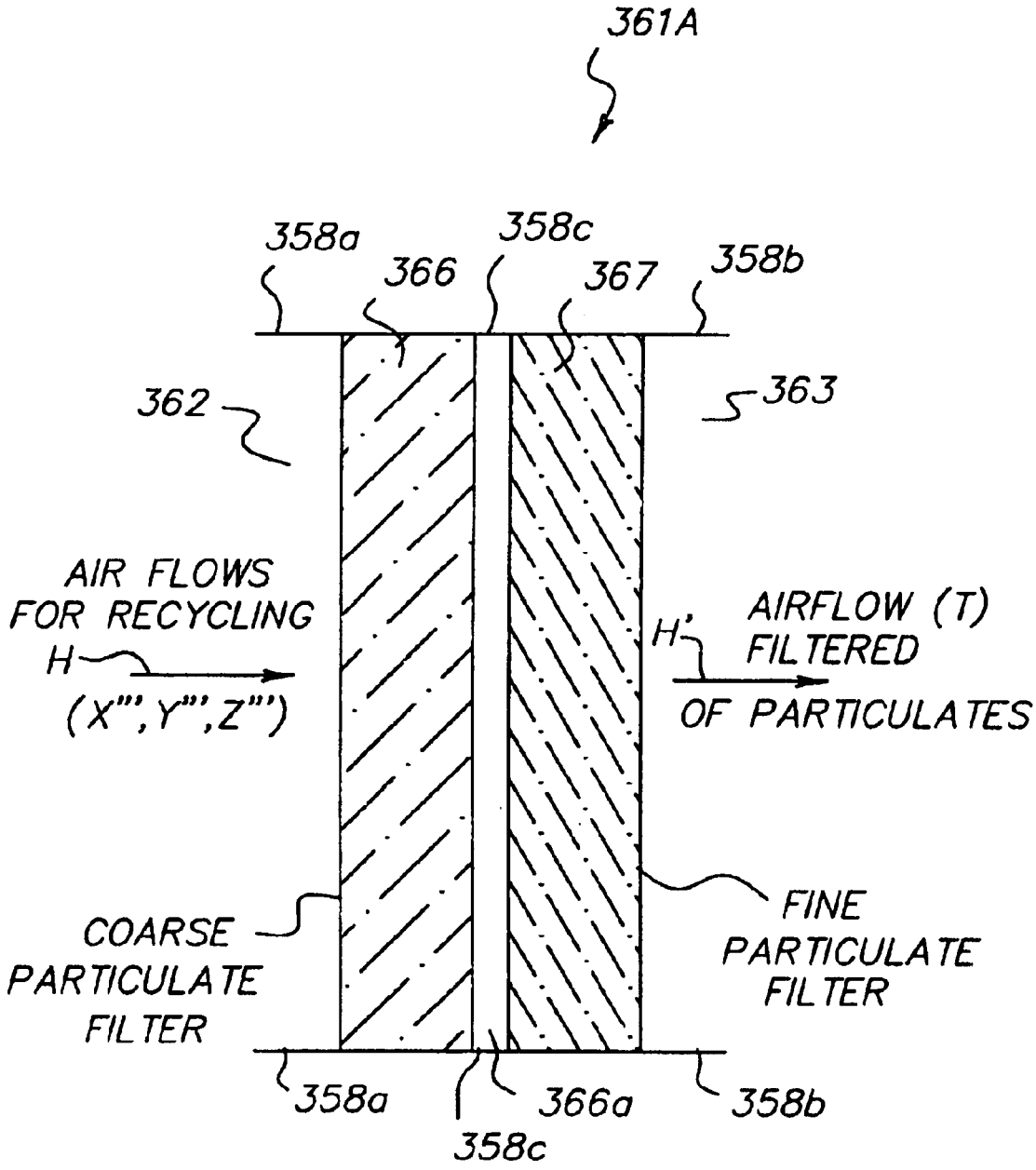
FIG. 3B schematically shows a side elevational view of a filtering unit for use with the air conditioning device of FIG. 3A.

As shown schematically in FIG. 3B, the incoming airflows X'", Y'" and Z'" enter filtering unit 361A in the direction of arrow H via an inlet duct 358*a*, passing first through a coarse particulate filter 366 and then through a fine particulate filter 367. Filters 366 and 367, which are supported in ductwork 358*c*, are separated by an air space 366*a*. The length of airspace 366*a* is preferably about 3 millimeters, but may be longer or shorter as may be required for optimized flow through filtering unit 361A.

The coarse particulate filter 366 (the first filter) is for trapping the largest particles which may be entrained in the air for recycling, e.g., particles having a dimension greater than a minimum dimension, which minimum dimension is preferably less than a diameter of any toner particles used in the modules. Preferably, the coarse particulate filter removes substantially all particles 10 micrometers in size or greater, and more preferably, all particles 5 micrometers in size or greater. A preferred coarse particulate filter is made from a wool of 6-Denier non-woven polyester with tackifier, the wool density being about 2 grams per square meter of filter cross-sectional area.

The fine particulate filter 367 is for removing fine particles having a dimension smaller than the minimum dimension of particles trapped by the coarse particulate filter. Preferably, the fine particulate filter is 90% effective in removing particles having diameters of about 0.1 micrometer. A preferred fine particulate filter material consists of needle-punched modacrylic and polypropylene staple permanently charged electret fibers, with a filter density of about 50 grams per square meter of filter cross-sectional area.

Notwithstanding the preferred disposition of filtering units 361A and 361B as illustrated in FIG. 3A, the filtering unit 361B may be placed in close proximity to, and downstream from, unit 361A.

As illustrated by FIG. 3A, airflow T is divided into a first stream of air labeled $V_1$ and a second stream of air labeled $V_2$, where $V_1$ and $V_2$ are respective airflow rates of the first stream and the second stream, the airflow streams moving in suitable ductage in the directions indicated by solid arrowheads. An airflow ratio equal to $V_1$ divided by $V_2$ can be a fixed ratio, which fixed ratio is non-adjustable during operation of the air-conditioning device. Alternatively, a mechanism (not indicated in FIG. 3A) can be used to adjust, in real time during operation of the air-conditioning device, the ratio of $V_1$ divided by $V_2$, for example by adjustably controlling airflow impedances which individually determine $V_1$ and $V_2$. In a preferred embodiment of air quality management apparatus disclosed below as embodiment 700 of FIG. 7, a fixed ratio of airflows $V_1$ divided by $V_2$ is approximately 0.77±0.20.

The first stream $V_1$ is cooled by flowing it past an evaporator coil 330, the evaporator coil provided with thermally conductive cooling fins 333 (indicated schematically) which fins are in thermal contact with the evaporator coil and which fins cool and dehumidify the first stream flowing past the cooling fins. (A helical shape of evaporator coil 330 is symbolical only, and has no relation to an actual shape, which shape may for example be a zig-zagging bent form or any other suitable or well-known form such as may commonly be used in the refrigeration and air-conditioning industries. Shapes of other coils included in FIG. 3A, as well as shapes of coils included in subsequent Figures, are also symbolical in the same sense.) The evaporator coil 330 is a thermally conductive tube containing a refrigerant, which refrigerant is moved as a cold mixture of gas and liquid through the interior of this tube by a refrigerant circulation mechanism (refrigerant circulation mechanism not illustrated). After having moved past the evaporator coil 330, the first stream ($V_1$) is mixed with the second stream ($V_2$) to form a recombined stream labeled T'. This recombined stream T' is flowed in a primary duct (not explicitly shown) past a reheat coil 350, having first passed through an internal filtering unit 361B.

Figure 3C:
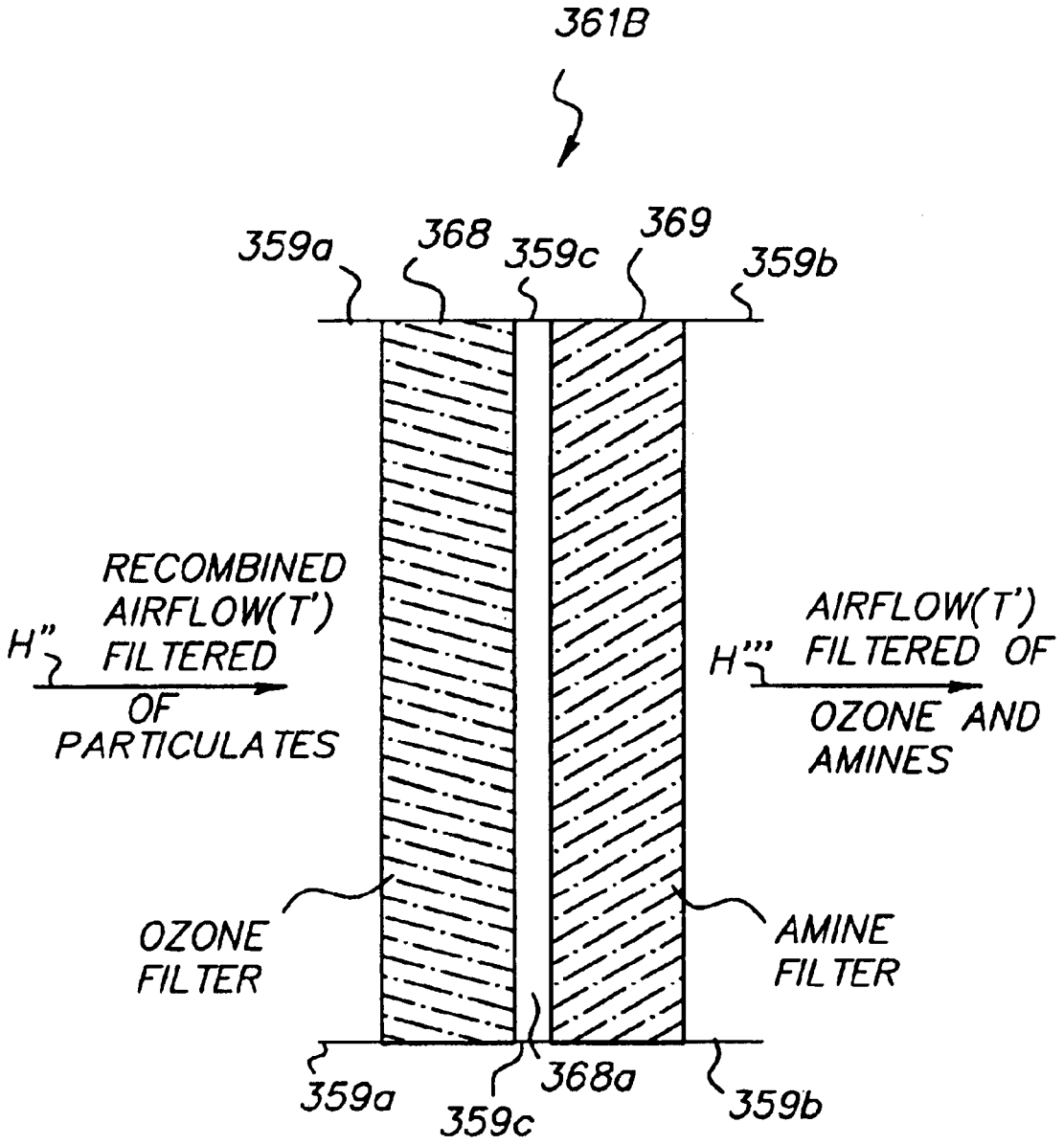
FIG. 3C schematically shows a side elevational view of an additional filtering unit for use in conjunction with the filtering unit FIG. 3B.

As shown schematically in FIG. 3C, the recombined stream T' enters filtering unit 361B in the direction of arrow H" via an inlet duct 359*a*, passing first through an ozone filter 368 and then through an amine filter 369. Filters 368 and 369, which are supported in ductwork 359*c*, are separated by an air space 368*a*. The length of airspace 368*a* is preferably about 3 millimeters, but may be longer or shorter as may be required for optimized flow through filtering unit 361B.

The ozone filter 368 is preferably a catalytic type filter for decomposing ozone to ordinary oxygen, although other types of ozone filter may be used. A preferred catalytic type ozone filter is a Nicheas TAK-C filter, which filter is about 20 millimeters thick and has about 560 cells per square inch, available from the Nicheas Company of Japan.

The amine filter 369 is for removing cyclohexylamine and other deleterious amines, and is preferably a catalytic type amine filter commercially available from the Nicheas Company of Japan. A preferred amine filter is about 30 millimeters thick and has about 350 cells per square inch.

Filtering unit 361B may be placed at any suitable location, e.g., prior to separation of flow T into flows $V_1$ and $V_2$, or, downstream from reheat coil 380. Alternatively, the filters included in filtering unit 361B may be included in filtering unit 361A, in manner as for example illustrated in FIG. 1C.

The recombined stream T' filtered of ozone and amines leaves unit 361B via duct 359*b* in the direction of arrow H'" and thence through reheat coil 350. The reheat coil 350 is provided with thermally conductive heating fins 345 (indicated schematically) which fins are in thermal contact with the reheat coil. Reheat coil 350 is for intermittent use for intermittently heating the recombined stream T'. During this intermittent use, a flow $F_1$ (indicated by labeled open arrowheads) of the refrigerant in the form of a hot compressed gas is flowed through the reheat coil 350, the reheat coil being a thermally conductive tube containing the hot refrigerant, with heat conducted therefrom for heating the recombined stream T' flowing past the heating fins 345. As described further below, the intermittent use of the reheat coil 350 for heating the recombined stream T' is controlled by a temperature controller 390. After passing the reheat coil 350, the recombined stream T' is flowed through a humidification unit 380 for intermittently humidifying the recombined stream.

In an alternative embodiment (not separately illustrated) a cooled and dehumidified flow (equivalent to $V_1$) is flowed past a reheat coil (equivalent to coil 345) before being recombined with a flow equivalent to flow $V_2$, thereby producing a recombined flow for passage through a filtering unit, e.g., equivalent to unit 361B, and from thence through a humidification unit equivalent to unit 380. Other elements included in this alternative embodiment are similar to those of embodiment 300.

After leaving the humidification unit (henceforth RH unit 380) the recombined stream, now labeled T" moves past main air circulation device 365 and emerges as stream T'" which is sensed by a temperature sensor 391 for sensing a temperature of recombined stream T'". Temperature sensor 391 is connected to temperature controller 390. The recombined stream T'" is also sensed by a relative humidity sensor 371 for sensing a relative humidity of the recombined stream, the relative humidity sensor being connected to a relative humidity controller 370. After being sensed by both the temperature sensor 391 and the relative humidity sensor 371, the recombined stream leaves plenum 392 and exits the air-conditioning device 300, e.g., divided into multiple post-exit airflows such as X", Y" and Z". Although sensors 371 and 391 are shown located within plenum 392, each of these sensors may alternatively be located at any suitable location downstream from device 365, e.g., at locations within ductwork carrying the airflow T'".

A temperature of the recombined stream T'", as sensed by temperature sensor 391 and sent to the temperature controller 390 as an electronic signal, is maintained by the temperature controller within a predetermined temperature range, the predetermined temperature range having a lowest temperature and a highest temperature, the predetermined temperature range including a target temperature which is preferably approximately midway in the predetermined temperature range. When a temperature of the recombined stream T'" is lower than this target temperature, an activation of heating by the reheat coil 350 (by flowing hot refrigerant through the reheat coil) is produced by a turn-on signal from the temperature controller, as described more fully below. Conversely, when a temperature of the recombined stream T'" is higher than the target temperature, a deactivation by a turn-off signal from the temperature controller 390 stops the flow of hot refrigerant through the reheat coil 350. The target temperature is preferably a set-point temperature, e.g., as determined by a logic circuit or other suitable mechanism in the temperature controller 390. A turn-on signal from the temperature controller activates a solenoid valve Q, labeled 355, which solenoid valve opens a gate for flowing hot refrigerant at a suitable flow rate $F_1$ through the reheat coil 350, while a turn-off signal from the temperature controller activates the valve Q so as to close this gate, thereby stopping the flow $F_1$ of hot refrigerant. In a preferred embodiment of air quality management apparatus disclosed below as embodiment 700 of FIG. 7, the lowest temperature within the predetermined temperature range is approximately 20.0° C., and the highest temperature is approximately 22.2° C.

A relative humidity of the recombined stream T'", as sensed by relative humidity 371 and sent to the relative humidity controller 370 as an electronic signal, is maintained by the relative humidity controller within a predetermined relative humidity range, the predetermined relative humidity range having a lowest relative humidity and a highest relative humidity, with the predetermined relative humidity range including a target relative humidity which is preferably approximately midway in the predetermined relative humidity range. When a relative humidity of the recombined stream T'" is lower than this target relative humidity, an activation of the RH unit 380 is produced by a turn-on signal from the relative humidity controller 370, as described more fully below. Conversely, when a relative humidity of the recombined stream T'" is higher than the target relative humidity, a deactivation by a turn-off signal from the relative humidity controller 370 stops humidification by RH unit 380. The target relative humidity is preferably a set-point relative humidity, e.g., as determined by a logic circuit or other suitable mechanism in the relative humidity controller 370. In a preferred embodiment of air quality management apparatus disclosed below as embodiment 700 of FIG. 7, the lowest relative humidity within the predetermined relative humidity range is approximately 30 percent, and the highest relative humidity is approximately 40 percent.

Relative humidity controller 370 and temperature controller 390 may be separate units, as indicated in FIG. 3A, or alternatively they may be combined in a single unit, such as for example a Watlow Series 998 Temperature/Process Controller available from Watlow Controls, Winona, Minn.

The humidification unit 380 may be any suitable humidification device for controllably and intermittently humidifying the recombined stream T', which humidification device may include: spray devices or aerosol devices such as for example water aerosol injectors such as piezoelectric or radio frequency aerosol generators, spray nozzles, as well as wettable elements such as pads, foams, sponges and the like, which wettable elements may be wetted by a spray device or by dipping into a reservoir of water. A water aerosol or a water spray may be introduced directly into the recombined stream T', or the recombined stream may be flowed past or through a wettable element.

Preferably, the humidification unit 380 includes a drip mechanism and a wettable pad for use with the drip mechanism, such as described below with reference to FIG. 8. An activation of RH unit 380 by a turn-on signal from the relative humidity controller 370 causes the drip mechanism to actively drip filtered water on to the wettable pad so as to keep the wettable pad suitably wet, thereby actively humidifying the recombined stream T' flowing past and contacting the wet wettable pad. A deactivation of RH unit 380 by a turn-off signal from the relative humidity controller 370 prevents the filtered water from being dripped on to the wettable pad. It is preferred that the drip mechanism is turned on only during activation and turned off during deactivation. Alternatively, the drip mechanism can be continuously adjustable via signals from the RH controller 370 so as to provide a variable drip rate of filtered water on to the wettable pad, giving improved control of relative humidity and thereby reduced fluctuations of relative humidity from the target relative humidity of airflow T'''. In an alternative embodiment of RH unit 380, a spray device instead of a drip mechanism may be used to intermittently spray filtered water from a nozzle on to the wettable pad, i.e., according to suitable activation or deactivation signals sent from RH controller 370. Moreover, the spray device may be a continuously running device, e.g., a nozzle continuously producing a spray of filtered water, such that a deactivation causes a mechanism to deviate the nozzle direction, e.g., such that the spray no longer wets the wettable pad, and conversely, an activation causes the mechanism to deviate the nozzle direction such that the recombined stream suitably wets the wettable pad. Any other suitable mechanism for intermittently and controllably providing active humidification of the recombined stream T' may be used.

Water for humidification purpose used in humidification unit 380 is typically not vaporized at full efficiency. As a result, a drain may for example be provided for removing from the printer such water for humification purpose which is not evaporated during humidification of air passing through humidification unit 380. Water for humification purpose which has not evaporated in the humidification unit 380 may alternatively be recycled for reuse therein.

The air-conditioning device 300 of FIG. 3A includes a closed-loop circuit, in which closed-loop circuit is circulated the refrigerant by the refrigerant circulation mechanism, with the refrigerant passing through successive devices including the aforementioned evaporator coil 330 and the reheat coil 350. Refrigerant flows are indicated by open arrowheads. In the evaporator coil 330 the refrigerant is evaporated from a liquid state to form a refrigerant gas, thereby cooling the first stream $V_1$. Downstream from the evaporator coil are sequentially located a pressure regulator 335 (labeled PR) and a compressor 340 for compressing the refrigerant gas to a compressed refrigerant gas, thereby heating the refrigerant gas. After leaving the compressor 340, hot compressed refrigerant gas flows to a solenoid valve 355 (labeled Q) located downstream from the compressor, which valve 355 is for opening a gate, thereby intermittently dividing the refrigerant flow into a main refrigerant flow $F_2$ and an intermittent auxiliary refrigerant flow $F_1$. Upon an activation signal by the temperature controller 390, solenoid valve Q diverts the flow $F_1$ through reheat coil 350, as indicated by the dotted-and-dashed lines in FIG. 3A. Conversely, upon a deactivation signal from temperature controller 390, the intermittent auxiliary refrigerant flow $F_1$ is shut off by the solenoid valve Q, as previously described above.

In an alternative embodiment, solenoid valve 355 is replaced by a 3-way continuously variable valve for improved control of the individual flows $F_1$ and $F_2$. The 3-way continuously variable valve allows a controlled auxiliary flow $F_1$ to be smoothly adjustable over a range of values via control signals sent from the temperature controller 390, thereby reducing variations of temperature of the flow T' and, as a result, reducing fluctuations from the target temperature of the airflow T'''. It is preferred to use negative feedback control with an error signal for adjusting the 3-way continuously variable valve so as to move the temperature of airflow T''' closer and closer to the target temperature.

Located downstream from gate 355 (and downstream from reheat coil 350) is a condenser coil 320, through which condenser coil are flowed the main refrigerant flow $F_2$ and any intermittent auxiliary refrigerant flow, $F_1$, e.g., as illustrated. The condenser coil, which is for cooling and thereby condensing part of the refrigerant to the liquid state, is a thermally conductive tube through which tube the refrigerant is flowed. After leaving the condenser coil 320, the refrigerant in the form of a liquid/gas mixture is circulated as flow $F_3$ through a Venturi or expansion valve 325 (labeled EV) and from thence back to the evaporator coil 330.

From outside the air-conditioning device 300 an ambient input airflow G of ambient air is drawn through an inlet, the inlet preferably provided with an entry filter, which entry filter is similar to a commercial furnace filter such as provided for filtering airflow $a_3$ of FIG. 1A. The ambient input airflow G may then be directed through an optional air compressor 310 for compressing the ambient input airflow into a compressed airflow. Airflow G flows past thermally conductive cooling fins 315 attached to condenser coil 320, which thermally conductive fins are in thermal contact with the condenser coil. Heat is absorbed by the (compressed) airflow from the refrigerant flowing within the condenser coil, thereby causing the (compressed) airflow to become a heated (and expanded) airflow, which heated (and expanded) airflow is expelled, through an outlet from the air-conditioning device 300, as a flow G' for suitable disposal outside of the printer, preferably outside of the room containing the printer.

The refrigerant used in the closed-loop circuit includes at least one fluorohydrocarbon. Preferably, the refrigerant is a mixture of about 50 percent by weight difluoromethane and about 50 percent by weight pentafluoroethane, such a mixture being commercially available as R410A.

Figure 4:
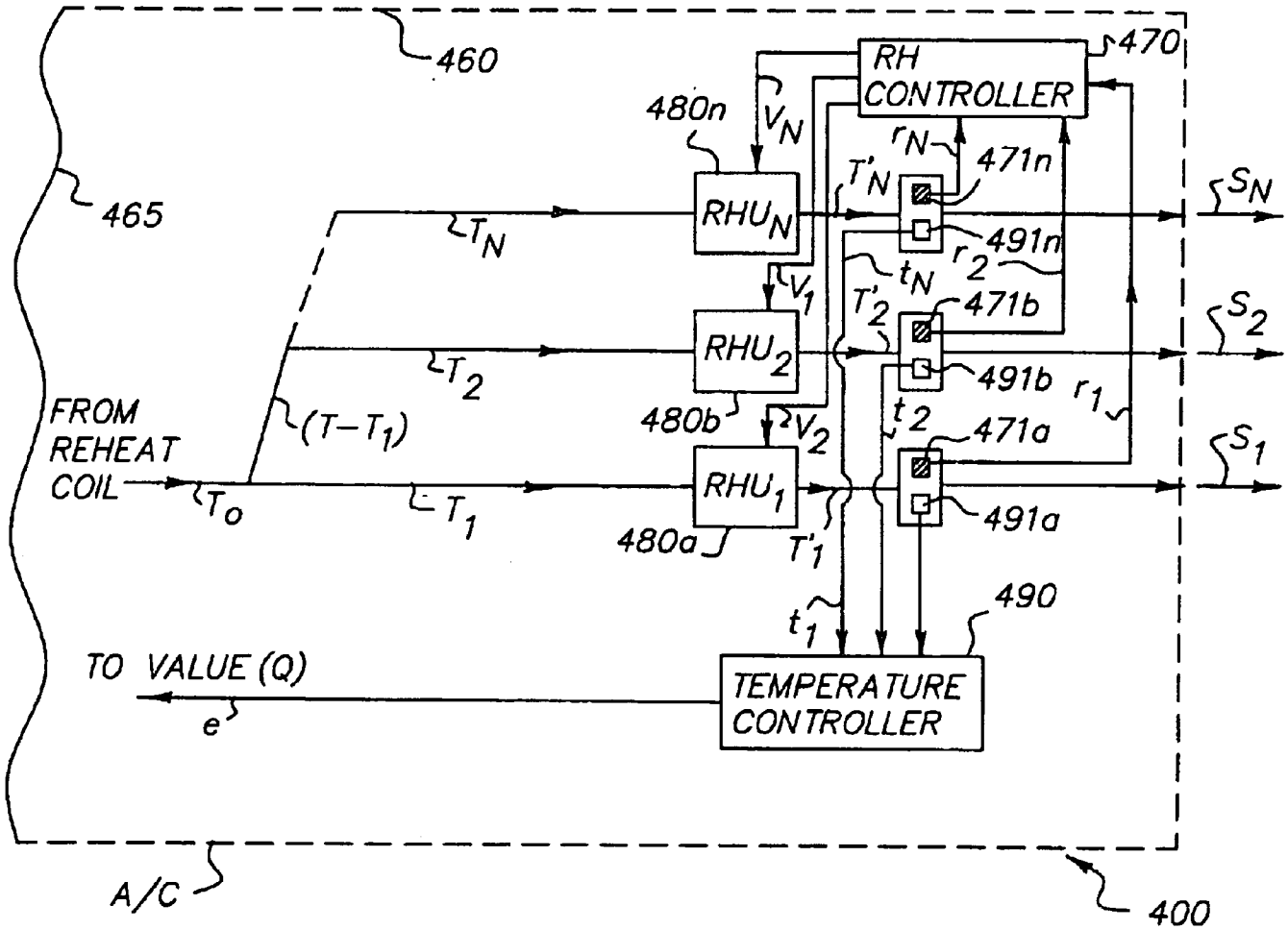
FIG. 4 schematically illustrates an alternative embodiment of an air-conditioning device for use in the air quality management apparatus of the invention.

An alternative embodiment of an air-conditioning device, designated 400, is illustrated in FIG. 4. Air-conditioning device 400 includes apparatus with a capability for producing at least two streams of individually air-conditioned air, each such stream having an individually controlled relative humidity. Each such stream passes through a corresponding exit for separate usage at differing locations within a primary volume for recycling, which primary volume for recycling is exemplified by the volume 130 indicated schematically in FIG. 1A. The working portion of air-conditioning device 400 is bounded by dashed line 460 and wavy line 465. To the left of wavy line 465, device 400 is entirely similar to device 300, such that an airflow $T_o$ in FIG. 4 is entirely equivalent to the recombined stream T' of FIG. 3A. Thus, in FIG. 4, a recombined stream $T_o$ flows in a primary duct (not shown) leading from a reheat coil (not shown) which is similar in all respects to reheat coil 350. Recombined stream $T_o$ is divided into more than one subflow, generally a number N of such subflows, indicated by $T_1, T_2, \ldots, T_N$, where $T_1$ is the first and $T_N$ is the last of these subflows, each subflow flowing in a corresponding secondary duct (secondary ducts not explicitly illustrated).

A respective subflow included in the $T_1, T_2, \ldots, T_N$ subflows passes through a respective secondary duct to a respective RH unit, the RH units being labeled $RHU_1, RHU_2, \ldots, RHU_N$ and correspondingly identified as 480*a*, 480*b*, . . . , 480*n*. After individual humidification to in the respective RH unit, the respective subflow now labeled with a prime (′), i.e., $T_1', T_2', \ldots, T_N'$, passes a respective RH sensor, the RH sensors being labeled 471*a*, 471*b*, . . . , 471*n*, and a respective temperature sensor, the temperature sensors being labeled 491*a*, 491*b*, . . . , 491*n*. Each of the RH units of FIG. 4 is similar in all respects to RH unit 380 of FIG. 3A, and likewise each RH sensor is similar in all respects to sensor 370, and each temperature sensor is similar in all respects to sensor 390. A respective RH unit operates intermittently in conjunction with a relative humidity controller (RH controller) 470 in a similar fashion as for air-conditioning device 300, i.e., to maintain a respective relative humidity, as sensed by the respective relative humidity sensor, within a respective predetermined relative humidity range bounded by a respective lowest relative humidity and a respective highest relative humidity. The respective predetermined relative humidity range includes a respective target relative humidity which is preferably approximately midway in the respective predetermined relative humidity range. Thus if the respective RH sensor indicates a respective relative humidity below the respective target relative humidity in the respective subflow, i.e., from a respective signal included in signals $r_1, r_2, \ldots, r_N$ sent to the RH controller 470, then a respective turn-on signal, included in signals $u_1, u_2, \ldots, u_N$, is sent to activate the respective RH unit. Similarly, a respective turn-off signal is sent to deactivate the respective RH unit when the respective relative humidity sensed by the respective relative humidity sensor is higher than the respective target relative humidity.

A temperature of the respective subflow included in the $T_1', T_2', \ldots, T_N'$ subflows is continuously sensed as a respective temperature signal by the respective temperature sensor, the respective temperature signal included in signals $t_1, t_2, \ldots, t_N$ being correspondingly sent to temperature controller 490. All temperature signals $t_1, t_2, \ldots, t_N$ are utilized at any instant by an algorithm in a data processor located within the temperature controller 490, which algorithm is for calculating a control temperature. This control temperature is maintained by the temperature controller 490 within a predetermined temperature range bounded by a lowest temperature and a highest temperature. The predetermined temperature range includes a target control temperature which is preferably approximately midway in the predetermined temperature range. A turn-on signal, e, from temperature controller 490 is sent to activate a solenoid valve (entirely similar in function to solenoid valve Q of FIG. 3A) when the calculated control temperature is lower than the target control temperature, thereby activating a flow of hot refrigerant through the reheat coil in a similar fashion as for air-conditioning device 300. Similarly, the flow of hot refrigerant through the reheat coil is stopped by a deactivation turn-off signal from temperature controller 490 when the calculated control temperature is higher than the target control temperature. The individual temperature signals $t_1, t_2, \ldots, t_N$ may have different weightings in the algorithm so as to optimize performance of air-conditioning device 400.

The subflows $T_1', T_2', \ldots, T_N'$ leave device 400 through exit ducts (not shown) as individually air-conditioned post-exit subflows, which are indicated as $S_1, S_2, \ldots, S_N$. It will be evident that any of these post-exit subflows may be divided into other flows for multiple usages, e.g., for use in the modules or in the associated auxiliary chambers. For example, different developers, for use in the different toning stations of the image-forming modules, typically have differing RH-dependent charge-to-mass (Q/M) ratios characterized by different sensitivities to changes of RH. Therefore, it is advantageous to deliver, from device 400, individually air-conditioned subflows so as to provide locally different relative humidities in the vicinity of, or in, the various toning stations within the individual modules, thereby providing stable and predictable developer performances. As another example, a post-exit airflow characterized by a given temperature (and relative humidity) may be divided for sending to each of the image writers used in the modules in order to cool the image writers similarly. As yet another example, a post-exit airflow characterized by a given temperature may be divided for generally ventilating each module and each auxiliary chamber so as to advantageously provide good dimensional stability for mechanical equipment located therein, such as drums or other equipment requiring high tolerance dimensional stability during operation.

Each of the post-exit subflows $S_1, S_2, \ldots, S_N$ has a tailored RH and an individual temperature having a certain deviation from the control temperature. Each deviation from the control temperature is specifically dependent upon: the algorithm, the weightings of temperature signals $t_1, t_2, \ldots, t_N$ in the algorithm, and on the fact that an act of humidification of a subflow produces a temperature change, i.e., a cooling. As a result of utilizing the algorithm, the device 400 provides a more limited temperature control of individual subflows than of RH control.

Although not illustrated in FIG. 4, each of the post-exit subflows $S_1, S_2, \ldots, S_N$ may be moved by a main recirculation device, or otherwise may be circulated through a specific pathway by an individual circulation mechanism. Thus, an individual blower (not shown) can be located downstream from $RHU_1$ and upstream from sensors 471*a* and 491*a* in order to propel airflow $S_1$. Similarly, individual respective blowers can be located downstream from $RHU_2, \ldots, RHU_N$ so as to propel respective airflows $S_2, \ldots, S_N$.

Figure 5:
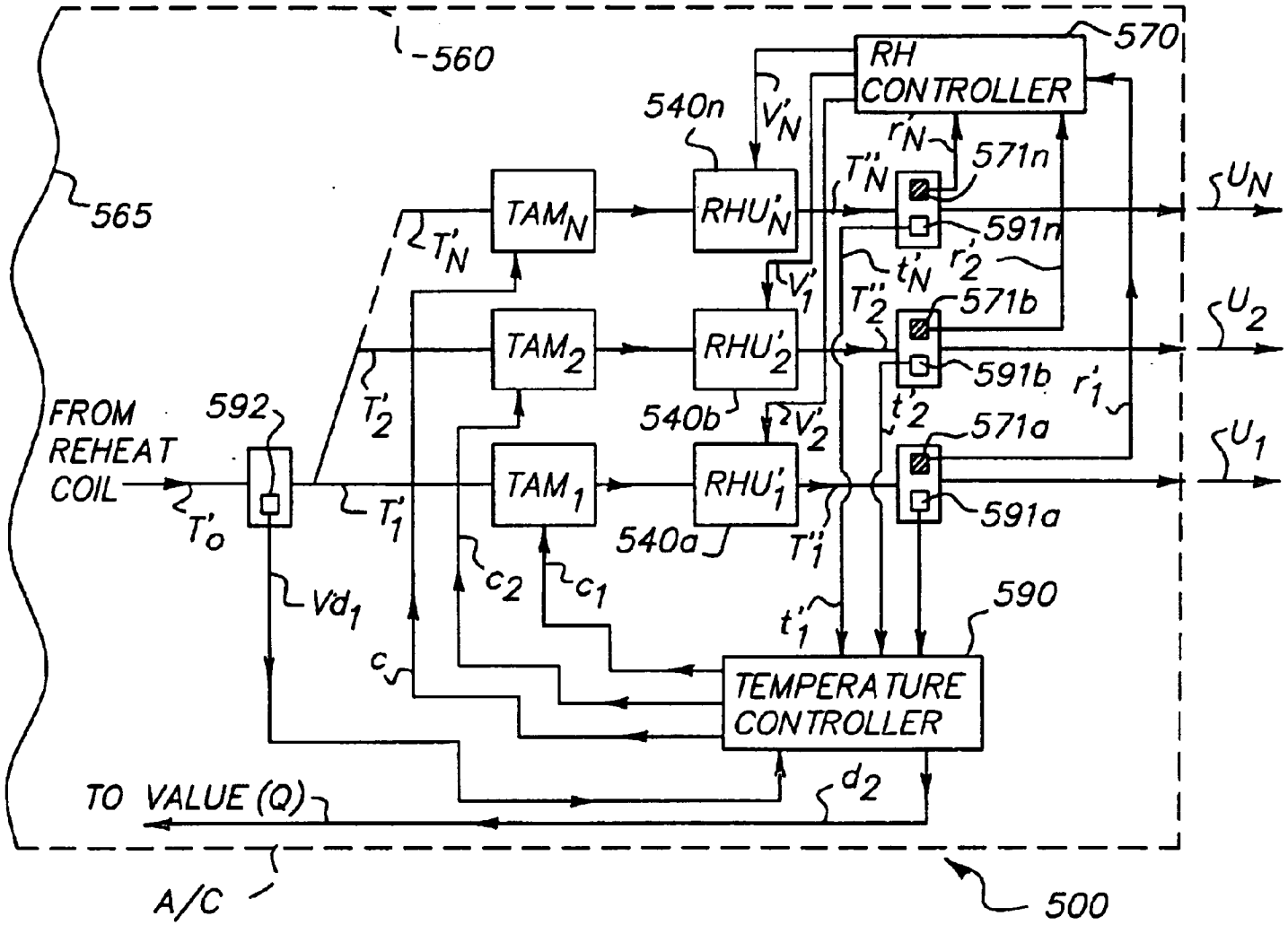
FIG. 5 schematically illustrates another alternative embodiment of an air-conditioning device for use in the air quality management apparatus of the invention.

Another alternative embodiment of an air-conditioning device, designated 500, is illustrated in FIG. 5. Air-conditioning device 500 includes apparatus with a capability for producing at least two streams of individually air-conditioned air, indicated as $U_1, U_2, \ldots, U_N$, with each such stream having an individually controlled relative humidity and temperature. Each such stream passes through a corresponding exit for separate usage at differing locations within a primary volume for recycling, as for air-conditioning device 400 of FIG. 4 (exits not illustrated). In FIG. 5, primed entities (′) are entirely similar to corresponding unprimed entities in FIG. 4. Moreover, the dashed line 560 and the solid line 565 are entirely analogous to the corresponding lines 460 and 465 of FIG. 4, and an RH controller 570 is similar in all respects to RH controller 470. Device 500 differs from device 400 by inclusion of temperature adjusting mechanisms, N in number, identified as 540*a*, 540*b*, . . . , 540*n*, and labeled $TAM_1$, $TAM_2$, . . . , $TAM_N$. Device 500 further differs from device 400 by inclusion of a temperature controller 590 which is connected to an auxiliary post-reheat temperature sensor 592 for sensing a temperature of recombined stream $T_o'$ arriving from the reheat coil (reheat coil not shown). Temperature sensors 591*a*, 591*b*, . . . , 591*n* are similar in all respects to temperature sensors 491*a*, 491*b*, . . . , 491*n*. Similarly, RH sensors 571*a*, 571*b*, . . . , 571*n* are similar in all respects to RH sensors 471*a*, 471*b*, . . . , 471*n* and are similarly controlled by RH controller 590.

A respective subflow (included in the subflows $T_1'$, $T_2'$, . . . , $T_N'$) flows past a respective TAM and a respective RHU', leaving the respective RHU' as a subflow indicated by a double prime ("), i.e., $T_1''$, $T_2''$, . . . , $T_N''$, and thence to a respective temperature sensor and a respective relative humidity sensor before emerging as a respective post-exit subflow included in the N post-exit subflows $U_1$, $U_2$, . . . , $U_N$.

The temperature adjusting mechanisms $TAM_1$, $TAM_2$, . . . , $TAM_N$ serve a purpose of allowing intermittent individual adjustments of temperatures of subflows $T_1''$, $T_2''$, . . . , $T_N''$ as sensed by the temperature sensors 591*a*, 591*b*, . . . , 591*n*, which individual adjustments are controlled by temperature controller 590 via corresponding signals $c_1$, $c_2$, . . . , $c_N$ sent from the temperature controller to the temperature adjusting mechanisms. These individual adjustments of temperature are made as corrections or augmentations to a post-reheat temperature of recombined stream $T_0'$ coming from the reheat coil and sensed by the auxiliary post-reheat sensor 592. A post-preheat temperature of the recombined stream $T_0'$, as sensed by auxiliary post-reheat temperature sensor 592, is sent as a signal $d_1$ to the temperature controller 590. This post-reheat temperature is maintained by the temperature controller 590 within a predetermined post-reheat temperature range bounded by a least post-reheat temperature and an uppermost post-reheat temperature. The predetermined post-reheat temperature range includes a target post-reheat temperature which is preferably approximately midway in the predetermined post-reheat temperature range. A turn-on signal, $d_2$, from temperature controller 590 is sent to activate a solenoid valve (entirely similar in function to solenoid valve Q of FIG. 3A) when the post-reheat temperature is lower than the target post-reheat temperature, thereby activating a flow of hot refrigerant through the reheat coil in a similar fashion as for air-conditioning device 300. Similarly, the flow of hot refrigerant through the reheat coil is stopped by a deactivation turn-off signal from temperature controller 590 when the post-reheat temperature is higher than the target post-reheat temperature.

The above-mentioned intermittent usage for adjusting a temperature of the respective subflow is controlled according to a respective signal (included in signals $c_1$, $c_2$, . . . , $c_N$) sent to the respective temperature adjusting mechanism from the temperature controller 590, the temperature controller being preset so as to maintain for the respective post-exit subflow a respective post-exit subflow temperature, which respective post-exit subflow temperature lies within a respective predetermined temperature range for the respective post-exit subflow, which respective predetermined temperature range for the respective post-exit subflow is bounded by a respective lowest temperature and a respective highest temperature. The respective predetermined temperature range for the respective post-exit subflow includes a target post-exit subflow temperature which is preferably approximately midway in the predetermined temperature range for the respective post-exit subflow. Thus, in response to a respective activation signal from temperature controller 590 sent to the respective temperature adjusting mechanism, a respective activation of the respective temperature adjusting mechanism by the temperature controller produces a respective alteration of the respective post-exit subflow temperature, and in response to a respective deactivation signal sent from the temperature controller to the respective temperature adjusting mechanism, a respective deactivation of the respective temperature adjusting mechanism by the relative temperature controller causes the respective alteration of the respective post-exit subflow temperature to cease, the respective activation of the respective temperature adjusting mechanism by the respective activation signal taking place only when the respective temperature sensor senses a respective post-exit subflow temperature that is different from the respective target temperature for the respective post-exit subflow, the respective activation being continued until the respective post-exit subflow temperature is approximately equal to the respective target temperature, whereinafter the respective activation is terminated by the respective deactivation signal.

Although each TAM in FIG. 5 is shown as preceding the corresponding RHU', a reverse order of these entities may be used in an alternative embodiment.

Each of the post-exit subflows $U_1$, $U_2$, . . . , $U_N$ may be moved by a main recirculation device, such as shown in FIG. 3A, or otherwise may be circulated through a specific pathway by an individual circulation mechanism (not illustrated in FIG. 5).

Although the post-exit subflows $U_1$, $U_2$, . . . , $U_N$ are shown leaving device 500 as individually air-conditioned airflows, it will be evident that any of these post-exit subflows may be divided into other flows for multiple usages, e.g., for use in the modules or in the associated auxiliary chambers.

An advantage of embodiment 500 is that post-exit subflows having separately controllable temperatures may be used to partially compensate for temperature variations within the printer typically arising from heat-producing components asymmetrically located with respect to sites where conditioned air is sent. These temperature variations are generally dependent on the relative positions of the modules with respect to one another and with respect to the heat-producing components. For example, the individual image writers in the various modules may not have identical temperature environments, so that individually conditioned air may be sent locally to each such image writer in order to provide an approximately identical temperature surrounding each of the image writers.

A temperature adjusting mechanism, included in the temperature adjusting mechanisms 540*a*, 540*b*, . . . , 540*n*, may be any suitable device for controllably raising or lowering a temperature of the corresponding post-exit subflow included in subflows $T_1''$, $T_2''$, . . . , $T_N''$. A suitable temperature adjusting mechanism is preferably electronically controllable, e.g., via turn-on and turn-off signals from the temperature controller 590. A suitable temperature adjusting mechanism is a Peltier-effect device such as utilized in the Suzuki et al. patent (U.S. Pat. No. 5,073,796), which Peltier-effect device, activatable and deactivatable by the temperature controller 590, has a cooling face and a heating face, such that a certain subflow may be brought into contact with either the cooling face or the heating face so as to respectively effect a cooling or heating of the subflow. Alternatively, either the cooling face or the heating face of a Peltier-effect device may be used at different times, such as may be required for either a cooling or a heating of a certain subflow. A temperature adjusting mechanism may for example also include: an electrical heater for heating a certain subflow, which heater may include a temperature control which is preferably electrically adjustable; and, a heating (cooling) element equipped with heating (cooling) fins in contact with a certain subflow, which heating (cooling) element includes pipes circulating a heating (cooling) fluid. Any suitable heating or cooling device may be used for a temperature adjusting mechanism.

Figure 6:
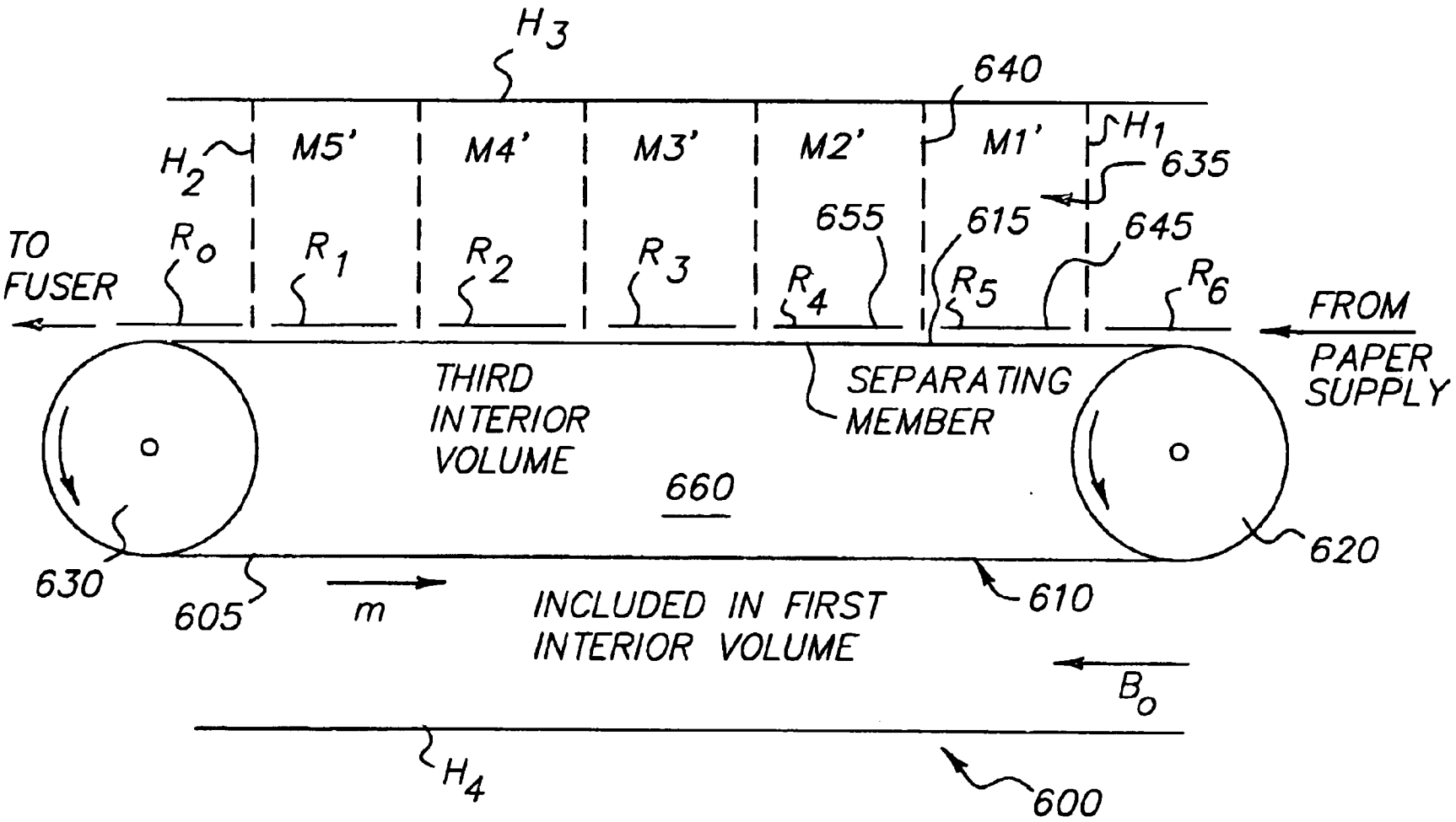
FIG. 6 is a simplified drawing depicting a modular electrostatographic printer which includes an air quality management apparatus of the invention.

FIG. 6 is a simplified drawing depicting a side view (front view) of a modular electrostatographic printer, 600, which printer includes certain volumes in which air quality is managed by an air quality management apparatus of the invention. The printer includes a moving transport web 610 for transporting receiver elements, e.g., cut paper sheets, through a number of tandemly arranged image-forming modules. FIG. 6 shows five such modules, M1', M2', M3', M4', and M5'; however, a lesser or a greater number of modules may be included. Divisions between the modules, e.g., division 640, have characteristics such as described for division 240 in FIG. 2. The transport web 610, supported in tension by drums 620 and 630, is rotatable in a direction indicated by arrow m for movement by the drums 620 and 630, which drums rotate anticlockwise as shown. Adhered, e.g. electrostatically, to transport web 610 are receiver elements, shown as $R_0$, $R_1$, $R_2$, . . . , $R_6$. Each receiver element is shown associated with a corresponding module, although a receiver element being transported through the printer may straddle two modules. Thus receiver element 645 ($R_5$) is associated with module M1', receiver element 655 ($R_4$) with module M2', and so forth.

Modules M1', M2', M3', M4', and M5' are included in the second interior volume of air managed by the air quality management apparatus, which second interior volume is shown generically in FIG. 1A. Thus, as indicated in FIG. 1A, these modules are provided by air-conditioned air from an air-conditioning device (not shown). The modules M1', M2', M3', M4', and M5' are generally enclosed in a housing, which housing includes walls $H_1$, $H_2$, and $H_3$. These walls $H_1$, $H_2$, and $H_3$ are preferably also included as delineating walls for the second interior volume. Each module is located in a volume, such as volume 635 enclosing module M1'. Preferably associated with modules M1', M2', M3', M4', and M5' are corresponding auxiliary chambers (not illustrated), which auxiliary chambers are also preferably included in the second interior volume, and which auxiliary chambers are for example similar in function to chambers A1, A2, A3, A4, and A5 of FIG. 2.

The transport web 610 has an upper portion 615, which upper portion provides a delineating surface for further defining the second interior volume. Similarly, transport web 610 has an lower portion 605, which lower portion provides a delineating surface for further defining the first interior volume. The first interior volume is also bounded by a wall $H_4$, such that a space between lower portion 605 and wall $H_4$, as indicated in FIG. 6, is included in the first interior volume (other delineating walls for the first interior volume not illustrated).

The air quality management apparatus of printer 600 includes a third interior volume, indicated as 660. A delineating boundary of this third interior volume is the entire web 610, the interior surface of which partially encloses the third interior volume. Front and rear walls (not shown) also define the third interior volume 660. In general, transport web 610 is not in contact with these front and rear walls, and spacings generally exist between each edge of the web (front and rear edges of the web) and the front and rear walls, which spacings permit leakages of air between the second interior volume and the third interior volume, and also between the third interior volume and the first interior volume. In effect, these leakages of air provide leakage paths between the first interior volume and the second interior volume, i.e., via the third interior volume. Such leakage paths are included in the generic air quality management apparatus of FIG. 1A.

In the printer 600, airflow through the first interior volume is in a general direction indicated by the arrow labeled $B_0$, i.e., beneath portion 605 of web 610. This direction is similar to the direction of airflow $a_3$ through the first interior volume shown in FIG. 1A. As a result of an overall pressure drop from right to left in the portion of the first interior volume shown in FIG. 6, leakage air tends to flow towards module M1', and away from module M5'. Thus a lesser amount of leakage occurs for the middle modules M2', M3', and M4' than for the end modules M1' and M5'. The module into which the greatest amount of non-air-conditioned leaks is module M1', and the module from which the greatest amount of air-conditioned leaks is module M5'. Because the second interior volume is a closed volume preferably having substantially no connection to air outside the printer, conservation of flow requires a total leakage flow rate flowing from the first interior volume to the second interior volume to be substantially equal to the leakage rate from second interior volume to the first interior volume. Airflow $B_0$ is eventually discharged from the printer in manner discussed above in relation to FIG. 1A.

The transport web 610 acts as a separating member for partially separating the first interior volume from the second interior volume. Moreover, as a separating member, the web 610 defines leakage pathways between the first interior volume and the second interior volume, these leakage pathways associated with the edges of the web, as described above. Other separating members (not illustrated) such as walls for separating the first interior volume and the second interior volume are generally included in printer 600, in addition to the separating member transport web 610. However, there are preferably no leakage pathways through these other separating members, i.e., negligible leakage air flow rates between the first interior volume and the second interior volume.

Air within volume 660 is a mixed air, this mixed air having characteristics intermediate between characteristics of the air included in the first interior volume and characteristics of the air included in the second interior volume, which characteristics include temperature and relative humidity. Thus, although this mixed air within the third interior volume 660 is not actively managed, the mixed air must nevertheless be included in the air managed by the air quality management apparatus of printer 600. For this reason, the air quality management apparatus is inclusive of the third interior volume.

Included in the first interior volume is a paper supply station (not shown) and a paper conditioning station (not shown). Paper from the paper supply passes through the paper conditioning station for conditioning at a certain temperature and a certain RH, in manner as is well-known. Receiver sheet $R_6$, e.g., a conditioned paper sheet, is shown arriving for passage into volume 635 to receive a toner image from module M1'.

Receiver sheet $R_0$ is shown having passed wall $H_2$, from whence the sheet $R_0$ is moved in known fashion to a fusing station (fusing station not shown). In known fashion, the fusing station typically includes a fuser for fusing toner images to receivers, and a post fuser cooler for cooling the fused images. An important advantage of the air quality management apparatus used in conjunction with printer 600 is that airflow $B_0$ advantageously moves past the fusing station in a direction away from the modules (in an arrangement of ductage such airflow $B_0$ the does not disadvantageously cool the fuser). The airflow $B_0$ entrains fuser oil volatiles and fuser oil aerosols, thereby carrying these contaminants away for eventual discharge from the printer. Airflow $B_0$ is preferably sufficiently large so as to substantially prevent fuser oil contamination from reaching the second interior volume, i.e., from reaching the modules via the leakage pathways described above. In certain prior art printers, fuser oil volatiles can diffuse or migrate through the printer, thereby causing problems such as gumming of components.

Relating to the above-described advantages of the direction and preferably large magnitude of airflow $B_0$ is a related advantage concerning management of a contaminant called acrolein (also known as acrylic aldehyde, or allyaldehyde), which acrolein may be hazardous to humans at low aerial concentrations. Acrolein can be volatilized from certain specialty papers when heated, e.g., from paper sheets heated in the paper conditioning station or in the fusing station. The direction and preferred magnitude of airflow $B_0$ ensure efficient removal of acrolein from the printer. If desired, acrolein may be filtered from air contained in the second interior volume, e.g., by a filtering unit such as filtering unit 161 of FIG. 1A. A commonly available 30 mm thick activated charcoal filter (such as available from Nicheas or from Puritec) may be used as a component of the filtering unit for removing acrolein.

A preferably large airflow $B_0$ also advantageously helps to keep contaminations from attaching or absorbing to the transport web 610, which contaminations may include gaseous contaminations as well as paper dusts from paper handling equipment, e.g., paper handling equipment located upstream from the web.

In an alternative embodiment to the embodiment 600, a defining wall (not illustrated) may be located under the lower portion 605, e.g., parallel with lower portion 605, which defining wall (rather than lower surface 605) is included as a delineating boundary surface for the first interior volume, this defining wall also having a function for partially defining the third interior volume.

In another alternative embodiment to embodiment 600, airflow $B_0$ may be flowed in a direction opposite to the direction shown in FIG. 6, i.e., in the same direction as arrow m rather than opposite to the direction of arrow m.

Figure 7:
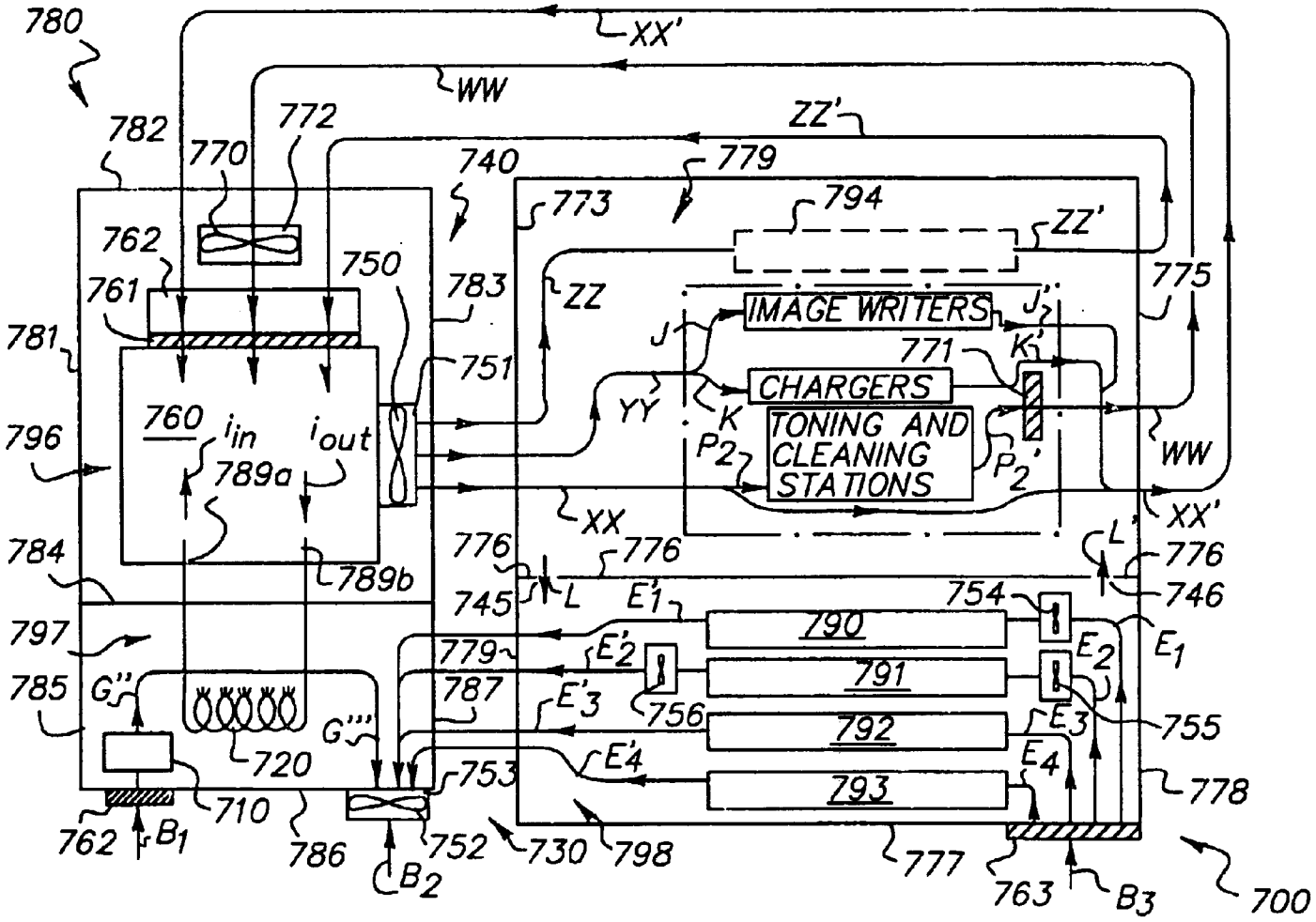
FIG. 7 schematically illustrates airflows in a preferred embodiment of an air quality management apparatus of the invention.

FIG. 7 is a schematic diagram of a preferred embodiment of an air quality management apparatus of the invention, indicated by the numeral 700, for inclusion in an electrostatographic printing machine similar to printer 600. Embodiment 700 includes four enclosures located within the printing machine: a first enclosure 796, delineated by walls or boundaries 781, 782, 783 and 784, which first enclosure includes refrigeration unit 760 for conditioning of air being recycled through device 760; a second enclosure 799, delineated by boundaries 773, 774, 775 and by at least one separating member 776, which second enclosure includes a number of electrostatographic image-forming modules and an equal number auxiliary chambers correspondingly associated with these modules; a third enclosure 798, delineated by boundaries or walls 777, 778, 779 and by the at least one separating member 776; and, a fourth enclosure 797, delineated by boundaries or walls 784, 785, 786, and 787, with boundary 784 being a common boundary or wall separating and preferably isolating the first enclosure 796 and the fourth enclosure 797 from one another. The first enclosure 796 and second enclosure 799 are included in the recirculation portion of the air quality management apparatus as exemplified in FIG. 1A. The third enclosure 798 is included in the open-loop portion as exemplified in FIG. 1A. The fourth enclosure 797 includes a fourth interior volume, described further below. An air-conditioning device for use in apparatus 700, indicated by the numeral 780, is partially housed in each of the first enclosure and the second enclosure, and is bounded by walls 781, 782, 783, 785, 786 and 787. Air-conditioning device 780 includes a refrigeration unit 760.

The at least one separating member 776 includes a transport web (not illustrated) which web encloses a third interior volume (not illustrated), which transport web is similar to transport web 610 enclosing third interior volume 660 in the printer 600 of FIG. 6. Moreover, leakage pathways 745 and 746 (through the third interior volume) allow leakage airflows L and L' to pass respectively from enclosure 799 to enclosure 798, and vice versa. The leakage flows L and L' move through gaps near edges of the transport web (not shown), as previously described above for printer 600. The at least one separating member 776 includes, in addition to web 610, any suitable additional dividing or boundary element for separating enclosures 798 and 799, e.g., a wall such as disclosed above in relation to printer 600, which additional dividing or boundary element (not illustrated) is supplementary to the transport web, and which additional dividing or boundary element preferably includes no leakage pathway between enclosures 798 and 799.

The refrigeration unit 760 provides a similar function as device 260 of FIG. 2, i.e., conditioning and circulating of air-conditioned air through the image-forming modules and through auxiliary chambers, which auxiliary chambers are preferably similar to the above-described auxiliary chambers of FIG. 2, and which auxiliary chambers are correspondingly associated with the image-forming modules as previously explained above. Thus, in fashion similar to apparatus 200 of FIG. 2, conditioned post-exit airflows labeled by arrows XX, YY, and ZZ (hereafter referred to as airflows or flows XX, YY, and ZZ) are moved by a main air recirculation device 750 from exits (not shown) in plenum 751 through suitable ductage(s) from enclosure 796 to enclosure 799, these airflows similar respectively to airflows X, Y and Z of FIG. 2. Main air recirculation device 750 and plenum 751 are similar in all respects to devices 250 and 251 of FIG. 2, i.e., the post-exit airflows XX, YY, and ZZ all have the same RH and temperature when leaving plenum 751. Walls 773 and 783 are physically separated by an air gap 740, and the flows XX, YY, and ZZ are moved across this air gap via flexible piping connections, which flexible piping connections also provide a degree of mechanical isolation by providing suppression of transmission of vibrations produced by equipment contained in enclosures 796 and 799.

The flow ZZ is moved to the auxiliary chambers for use therein, which auxiliary chambers are symbolically indicated in FIG. 7 by the dashed line 794 (line 794 has no physical meaning). Connections to, and exits from, individual auxiliary chambers are not illustrated. Thus the flow ZZ may be passed through the auxiliary chambers 794 sequentially. Preferably, flow ZZ is divided for individual delivery to each of the auxiliary chambers 794. Air that has passed through auxiliary chambers 794 moves out from a common exit (not illustrated) as a flow ZZ' for reconditioning. The flow ZZ', similar to flow Z' in FIG. 2, moves in appropriate piping back to a plenum 762, and from thence through a filtering unit 761 for reconditioning by device 760, the piping preferably made from flexible material for providing a degree of mechanical vibration isolation. In one embodiment of air-conditioning device 780, plenum 762 and filtering unit 761 are preferably similar to plenum 262 and filtering unit 261 of FIG. 2, respectively. In particular, filtering unit 761 of this embodiment preferably has similar filters, as well as a similar predetermined order of filters, as filtering unit 261, e.g., a coarse particulate filter, a fine particulate filter, an ozone filter, and an amine filter, these filters listed in a preferred order of passage of flow ZZ' through the filtering unit 761. In another embodiment of air-conditioning device 780, filtering unit 761 is preferably similar to unit 361A, e.g., as shown in FIGS. 3A and 3B, with an internal filtering unit for removing ozone and amines, e.g., preferably similar to unit 361B of FIGS. 3A and 3C, also being provided (not shown). A differential pressure drop across filtering unit 761 may be electronically measured, e.g., for monitoring aging of the filters for replacement, particularly the particulate filters, and an associated differential pressure switch (not illustrated) can be activated as may be necessary, e.g., to modify airflow rates or to provide an alert signal.

The flow XX is a flow of air-conditioned air which is used for overall bathing of the image-forming modules of the printer, which modules are symbolically indicated in FIG. 7 by the dot/dash line 795 (line 795 has no physical meaning). Flow XX may be flowed past the individual modules sequentially. Preferably, flow XX is divided for individual delivery to each of the modules (individual modules not indicated). Thus, the flow XX flows past any primary imaging members, intermediate transfer members, transfer rollers and the like included in the modules. The flow XX also provides overall bathing of subsystem stations such as charging stations, toning stations, cleaning stations and the like included in the modules.

A portion $P_2$ of flow XX is drawn toward the general vicinities of toning stations and cleaning stations included in the modules, which cleaning stations can for example be used for cleaning primary imaging members, intermediate transfer members, or any drums or webs included in the modules that may require cleaning by a cleaning device. The remainder of flow XX for bathing of the modules is shown as airflow $P_1$. A flow $P_2$' from these general vicinities is removed by suction for recycling. Alternatively, the flow $P_2$' may come from locations within the toning stations and cleaning stations included in the modules. The flow $P_2$' may be passed through an optional auxiliary filter 771 which is similar to filter 271 included in the apparatus 200 of FIG. 2, i.e., filter 771 is a combination developer dust filter and cleaning station debris filter. Flow $P_2$', after passing through filter, 771 emerges from an exit (not shown) as a flow WW for recycling, which flow WW is similar in nature to flow W in FIG. 2. Flow WW flows past an auxiliary air moving device 770 located in a housing 772, and from thence back to the plenum 762 via piping preferably made from flexible material for providing a degree of mechanical vibration isolation. Auxiliary air moving device 770 is similar in function to device 270 of FIG. 2.

Certain flows of air-conditioned air may be delivered directly for use in individual subsystem stations. Thus, the flow YY is for use by image writers and certain charging devices included in the image-forming modules 795 of the printer. A portion, J, of flow YY is for cooling image writers included in the modules (image writers not identified). The flow J may be flowed past the image writers sequentially. Preferably, flow J is divided for individual delivery to each of the image writers. The remainder of flow YY is a flow K for purpose of ventilating certain ones of charging devices included in the second interior volume, such as for example primary corona chargers for charging photoconductive primary imaging members in the modules. The flow K may be flowed through or past the charging devices sequentially. Preferably, flow K is divided for individual delivery to each of the certain ones of the charging devices. After respectively cooling image writers and ventilating charging devices, airflows J' and K' leaving these writers and charging devices become combined with airflow $P_1$ and moved out from enclosure 799 as a flow XX' for reconditioning, e.g., via a common exit (not illustrated). The flow XX', similar to flow X' in FIG. 2, moves back to the plenum 762 via piping preferably made from flexible material for providing a degree of mechanical vibration isolation.

Enclosure 798 includes the first interior volume previously described above, which first interior volume includes a paper cooler 791 and a paper heater 792, the paper cooler and paper heater used for paper conditioning in a paper conditioning station included in the printer, and a post fuser cooler 790 included in a fusing station (fusing station not indicated in FIG. 7). Ambient air is drawn into the first interior volume as flow $B_3$ via at least one inlet port (inlet ports not illustrated) leading into enclosure 798. Airflow $B_3$ is filtered by a suitable filtration, e.g., by an inlet port filter 763 similar to a high-throughput commercial residential furnace filter, and divided into a plurality of streams, e.g., four flows labeled $E_1$, $E_2$, $E_3$, and $E_4$. A plurality of pathways for carrying the plurality of streams connects the at least one inlet port with at least one outlet port located in wall 779. Flow $B_3$ is for managing air quality of air flowing through and included in the first interior volume, i.e., which managing includes removal of heat generated within the first interior volume as well as removal of contaminations such as ozone, acrolein, amines or water vapor that may be present within enclosure 798.

Flow $E_1$ flows in a pathway through the post fuser cooler 790, which post fuser cooler is for cooling receiver members after fusing toner images on the receiver members with the fuser in the fusing station. The post fuser cooler pathway includes a cooling auxiliary fan 754, which cooling auxiliary fan is located for example upstream (as shown) or alternatively downstream from the post fuser cooler, which post fuser cooler is included in the fusing station (fusing station not shown). Fan 754 may have adjustable power. Airflow $E_1$, after passing through the post fuser cooler 790, is vented from enclosure 798 as an airflow $E_1$' through an outlet port (not shown) located in wall 779.

Flow $E_2$ flows in a pathway through the paper cooler 791, which pathway includes a pre-cooling auxiliary fan 755 and a post-cooling auxiliary fan 756, the paper cooler included in the paper conditioning station, which paper cooler is used to cool paper after conditioning of the paper by the paper heater 792 at elevated temperature. Fans 755 and 756 may have adjustable power. Airflow $E_2$, after passing through the paper cooler 791, is vented from enclosure 798 as an airflow $E_2$' through an outlet port (not shown) located in wall 779.

Flow $E_3$ flows in a pathway past the paper heater 792, and is vented from enclosure 798 as an airflow $E_3$' through an outlet port (not shown) located in wall 779. An advantage of apparatus 700 is that noxious fumes which may be emitted by the paper heater are carried away by separate piping which keeps such fumes from migrating throughout the interior of the printer or escaping from the printer into the room housing the printer.

Flow $E_4$ flows in one or more pathways through frame portions of the printer, symbolically labeled "frame" in FIG. 7, and indicated by numeral 793. The flow $E_4$ is for general usage in bathing frame portions included in the first interior volume, which frame portions are interior spaces supported by framework included in the printer. Airflow $E_4$, after passing through the frame portions 793, is vented from enclosure 798 as an airflow $E_4'$ through an outlet port (not shown) located in wall 779.

The outflows $E_1'$, $E_2'$, $E_3'$, and $E_4'$ may leave via separate outlet ports, as indicated in FIG. 7, or may alternatively be combined for expulsion from enclosure 798 as a combined flow. Air included in the outflows $E_1'$, $E_2'$, $E_3'$, and $E_4'$ passes through flexible connecting ductage (not shown) leading from enclosure 798 to enclosure 797, which flexible connecting ductage provides a degree of mechanical vibration isolation between the third and fourth enclosures (there is a physical gap between walls 779 and 787).

In an alternative embodiment of air quality management apparatus 700, for use with a printer having a stand-alone paper conditioning unit, paper cooler 791 and paper heater 792 and their respective airflows $E_2$ and $E_3$ are not included in the air quality management apparatus, so that the fans 755 and 756 (and ductage for airflows $E_2$ and $E_3$) are omitted.

The fourth enclosure 797 bounded by walls 784, 785, 786, and 787 encloses a fourth interior volume. This fourth interior volume is distinct from each of the first interior volume and the second interior volume (and distinct from the third interior volume which is not illustrated in FIG. 7). There is preferably no airflow or air leakage between the fourth interior volume and each of the first and second (and third) interior volumes. Airflows $E_1'$, $E_2'$, $E_3'$, and $E_4'$ are piped through enclosure 797 in suitable ductage (not illustrated) for expulsion through an exit duct (not explicitly shown) to a location for disposal outside of the printer. Airflows $E_1'$, $E_2'$, $E_3'$, and $E_4'$ do not mix with air in enclosure 797 and are included in an airflow $B_2$ leaving the printer. The airflows $E_1'$, $E_2'$, $E_3'$, and $E_4'$ are all moved through the various pathways 790, 791, 792, and 793 primarily by suction from a main air moving device 752 located in a housing 753 (the devices 754, 756 and 757 are supplementary air movers).

In addition to providing a suction to draw flow $B_3$ inside enclosure 798, the main air moving device 752 also provides a suction to draw from outside the printer an ambient airflow $B_1$ into enclosure 797. Ambient airflow $B_1$ is drawn from outside the printer through an inlet (not shown) and an entry filter 762 for passage past condenser coil 720. Airflow $B_1$ may then be passed through an optional air compressor 710 for compressing flow $B_1$ into a compressed airflow G", the air compressor included in the fourth enclosure 797. The entry filter 762 is a high throughput filter, similar to a commercial residential furnace filter, for filtering airborne particles from airflow $B_1$ entering enclosure 797. The (compressed) airflow flows past thermally conductive cooling fins 721 in thermal contact with thermally conductive condenser coil 720. Heat is absorbed by the (compressed) airflow from a refrigerant flowing within the condenser coil 720, thereby cooling the refrigerant and also causing the (compressed) airflow to become a heated (and expanded) airflow G'". The heated and expanded airflow G'" is expelled from the fourth interior volume by passage through an exit duct (not shown) into plenum 753 where flow G'" is merged into flow $B_2$. Although air flowing through the fourth interior volume does not directly affect air quality in the image-forming modules or in apparatus such as paper conditioning apparatus and fusing apparatus, the fourth interior volume is nevertheless considered an integral part of the air quality management apparatus 700 inasmuch as the ambient air input flow rate $B_1$ and the post-air-compressor airflow rate G" are managed factors in determining proper operation of the condenser coil 720. Efficient and space-saving use of a single blower 752 for moving airflows G'", $E_1'$, $E_2'$, $E_3'$ and $E_4'$ is a unique feature of apparatus 700.

It is preferred that air-conditioning device 780 is similar to device 300 of FIG. 3A, meaning that device 780 includes functionally similar elements, ductage, and materials as device 300. Air-conditioning device 780 therefore preferably includes a closed-loop circuit for flowing a refrigerant, preferably a fluorohydrocarbon refrigerant, through successive devices included in the closed-loop circuit, the refrigerant being circulated as a refrigerant flow by a refrigerant circulation mechanism (not illustrated). The refrigerant circulation mechanism is included in refrigeration unit 760. The successive devices through which the refrigerant is circulated are: the condenser coil 720 (similar to coil 320) from which refrigerant flows in tubing 789*a* through wall 784 into the refrigeration unit 760 in a direction shown by arrow labeled $i_m$; an evaporator coil (not illustrated, similar to coil 330) in which the refrigerant is evaporated from a liquid state to form a refrigerant gas; a compressor (not illustrated, similar to compressor 355) located downstream from the evaporator coil, the compressor for compressing the refrigerant gas to a compressed refrigerant gas; and, a gate (not illustrated, similar to gate 340) located downstream from the compressor, which gate is for dividing the refrigerant flow into a main refrigerant flow (not shown) and an intermittent auxiliary refrigerant flow (not shown), the gate activated by a solenoid valve (not shown) for intermittently flowing the intermittent auxiliary refrigerant flow through a reheat coil (not shown). The evaporator coil, the compressor for compressing the refrigerant gas, the gate and the reheat coil are all located within refrigeration unit 760. The condenser coil 720 is located downstream from the gate and downstream from the reheat coil. The main refrigerant flow and the intermittent auxiliary refrigerant flow are together flowed back from unit 760 through wall 784 within tubing 789*b* to the condenser coil 720 in a direction shown by arrow labeled $i_{out}$, and the refrigerant is thereby re-condensed to the liquid state in the condenser coil for recirculation through unit 760.

There are for example five tandemly arranged electrostatographic image-forming modules symbolically indicated as 795.

Managing of air quality of air included in and circulating within the second interior volume includes removing, by refrigeration unit 760 of air-conditioning device 780, excess heat generated within enclosure 799 by heat-generating devices, e.g., for operating modules 795. Heat generated within the second interior volume is generated according to the following heat generation rates: about 500 watts from the image writers, about 500 watts from elsewhere in the modules 795, about 1500 watts from the main air recirculation device 750 and the auxiliary air moving device 770, and about 1500 watts from heat-generating devices housed in auxiliary chambers 794. Heat-generating devices included in the recirculation portion of apparatus 700 include mechanical devices, power supplies, motors, electrical equipment, electrical circuit boards, and the like. A specified total rate of recirculation of air included in the second interior volume is approximately 1180 cubic feet per minute, which specified total rate of recirculation is included in a range between approximately 1080 cubic feet per minute and 1380 cubic feet per minute.

Managing of air quality of air within the first interior volume includes removal of excess heat generated within enclosure 798. Heat generation rates managed within the first interior volume, the first interior volume including five image-forming modules 795 are, for example: about 1000 watts from the post fuser cooler 790, about 300 watts from the cooling auxiliary fan 754, about 1000 watts from the paper cooler 791, about 300 watts from each of the pre-cooling auxiliary fan 755 and the post-cooling auxiliary fan 756, about 2500 watts from the paper heater 792, and about 4000 watts from the one or more pathways through frame portions indicated as frame 793.

Ambient inlet air flow $B_1$ into the enclosure 797 is at least about 1250 cubic feet per minute, and the ambient inlet air flow $B_3$ into the enclosure 798 is about at least 1180 cubic feet per minute. Thus the outflow $B_2$ is about at least 2430 cubic feet per minute, and may be as much as 2950 cubic feet per minute. Airflow $B_3$ is equal to a specified total airflow rate through the first interior volume, which specified total airflow rate is approximately 1180 cubic feet per minute ±200 cubic feet per minute.

The outflow $B_2$ also carries away a certain heat produced by a fuser located in the fusing station included in the printer, the fuser for fusing toner images to receiver members, as is well known. A fusing-station-related flow of air included in the air flowing through and included in the first interior volume also carries fuser oil volatiles emitted by the fuser away from the fuser. Preferably, this fusing-station-related flow is included in the frame flow $E_4'$. The fusing station is sited within the first interior volume at a location such that the fuser oil volatiles are swept away in advantageous fashion such that substantially none of the fuser oil volatiles reaches the modules, e.g., swept away via the leakage flow rate L' of air from the first interior volume to the second interior volume. Preferably, the fusing station is sited such that the fusing-station-related flow passes proximate to the fusing station, yet not through the fusing station, i.e., so as not to disadvantageously cool the fuser.

It has been unexpectedly and surprisingly found that performance of apparatus 700 is optimized if the specified total airflow rate through the first interior volume (managed by the open-loop portion) and the specified total rate of recirculation in the second interior volume (managed by the recirculation portion) are approximately equal. Preferably, the specified total airflow rate and the specified total rate of recirculation differ from one another by less than about 5 percent.

When a printer utilizing apparatus 700 is in a stand-by mode, e.g., when prints are not being generated or when the printer is otherwise idle, reduced stand-by values may be specified for both the specified total airflow rate and the specified total rate of recirculation so as to constantly maintain both the temperature and the relative humidity of airflows XX, YY and ZZ at nominal levels, thereby saving energy of operation of the printer.

In an alternative embodiment of the air quality management apparatus, for employment with a printer in which various weight papers are used as receivers for different printing runs, airflow rates can be appropriately adjusted when different weight receivers are being printed on. In particular, the specified total airflow rate can be separately specified for each such weight of receiver, and the total airflow rate correspondingly adjusted. In general, different weight receivers require different heat loads to removed from the first interior volume, e.g., for light papers and heavy papers. To compensate for such different heat loads, certain of the airflows in the first interior volume, such as in enclosure 798 of FIG. 7, can be adjusted for better performance, or for saving energy. For example, airflows can be adjusted in order to minimize energy lost from the fusing station included in the printer, or for optimizing performance of the paper conditioning station for different weights of receivers.

Figure 8A:
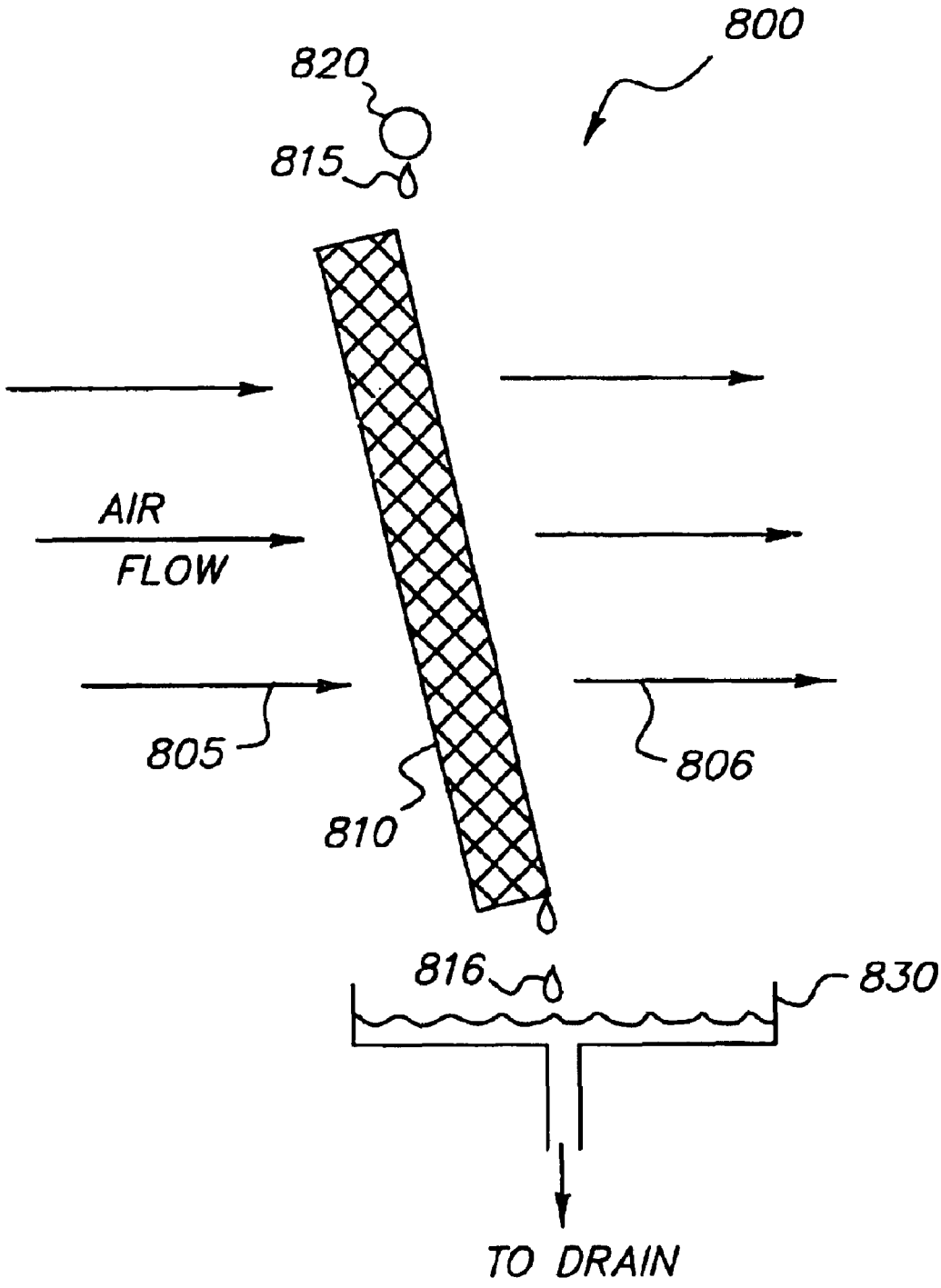
FIGS. 8A and 8B schematically, respectively, show side and front elevational views of a humidification device for use within an air quality management apparatus of the invention.
Figure 8B:
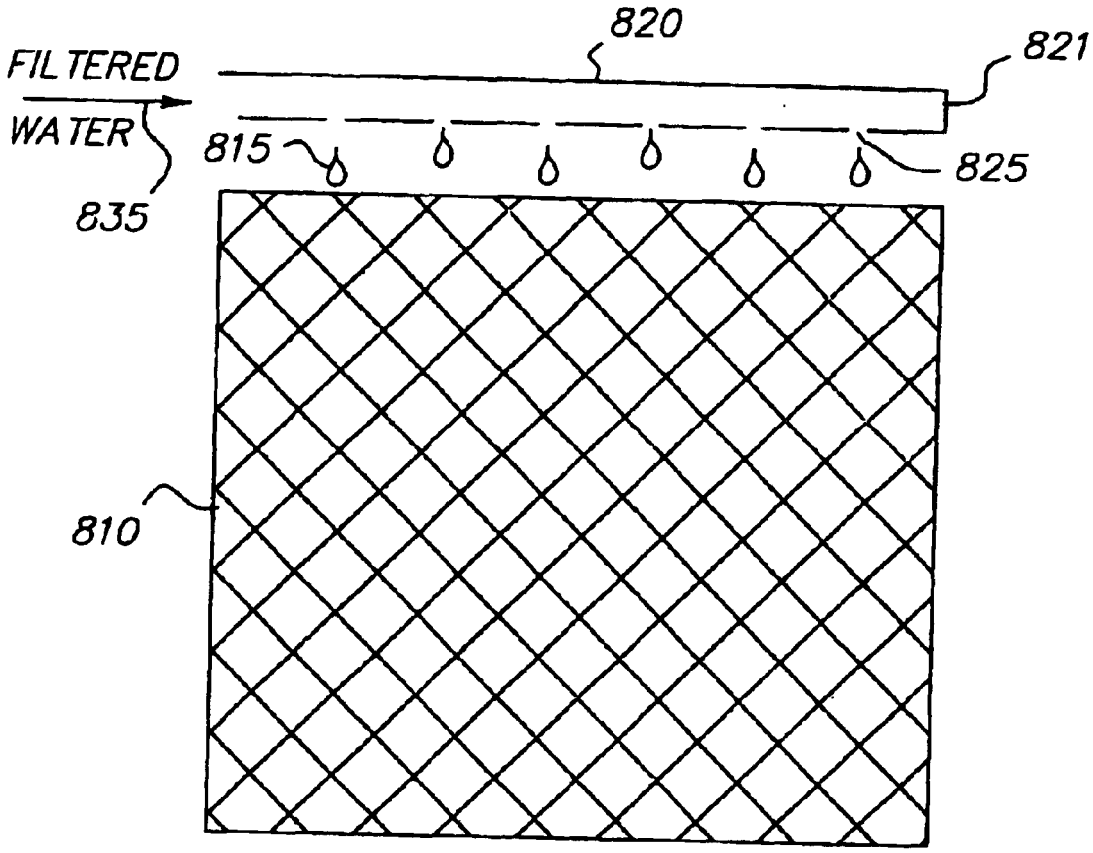

FIG. 8 schematically illustrates a preferred humidification device, indicated as 800, for inclusion in a humidification unit of an air-conditioning device included in an air quality management apparatus of the invention. In FIG. 8A is shown a side elevation of the humidification device, with an airflow indicated by arrows 805 upstream of an absorbent wettable pad 810, and an airflow indicated by arrows 806 downstream of the wettable pad 810, with airflow 806 having passed through the wettable pad. A drip mechanism in the form of a pipe 820 is for carrying filtered water to the device 800 and for dripping droplets 815 of filtered water on to an upper portion of the wettable pad 810. Droplets 815 of water are absorbed by the wettable pad, and evaporation of water vapor from a wetted pad 810 humidifies airflow 805 and thereby provides a humidified downstream flow 806. Excess water droplets 816 from water flowing downward under gravity from a saturated pad 810 drips into a drain pan 830. In FIG. 8B, a view is shown from downstream of pad 810. The underside of pipe 820 is provided with a set of holes 825 from which droplets 815 fall. Preferably, the holes 825 in pipe 820 are about 0.015 inches in diameter and equi-spaced about 2 inches apart. A flow of filtered water is provided under pressure as necessary, as shown by arrow 835, with pipe 820 having an end cap 821 so that water may be forced through the holes 825.

The pad 810 has an open structure so as to permit airflow 805 to flow with a low impedance through the pad. Filtered water as provided by flow 835 is typically ordinary mains water that has been deionized and from which particulates have been removed by a water filtering unit. A preferred water filtering unit is manufactured by the International Water Technology Corporation, model "Ion Exchange" Research II Grade, which includes a low pressure filter operated under a regulated water pressure of about 30 psi.

As previously described above, e.g. with reference to FIG. 3A, a relative humidity unit is activated or deactivated as needed for controlling the relative humidity of air leaving the air-conditioning device located in the recirculation portion of the air quality management apparatus. With reference to FIGS. 8A and 8B, humidification device 800 is activated by opening a valve, thereby providing water flow 835 and producing droplets 815 (valve not shown). As for example described above in relation to air-conditioning device 300 of FIG. 3A, this valve is opened intermittently by a valve control mechanism (not shown) after an activation signal is sent from an RH controller (not shown and similar for example to RH controller 370) to the valve control mechanism. Conversely, device 800 is deactivated by closing the valve after a deactivation signal is sent from the RH controller to the valve control mechanism, thereby causing the formation of droplets 815 to cease. Preferably, the valve control mechanism is an electrically operated solenoid. In an alternative embodiment, the valve is continuously adjustable via control signals from the RH controller to the valve control mechanism using negative feedback and an error signal, thereby continuously adjusting the drip rate of drops 815 so as to provide flow 806 with a variable amount of humidification.

During active humidification by device 800, as much as 85% of the water for humidification purpose can be lost to the drain and may profitably be recycled. In an alternative embodiment, drops 816 are collected by a collecting mechanism and the resulting water is returned through suitable tubing (not shown) and valving (not shown) to pipe 820 for reuse for humidification, e.g., by means of a return pumping mechanism and refiltration as may be necessary of the recovered water through an optional auxiliary filter (return pumping mechanism and optional auxiliary filter not shown).

Figure 9:
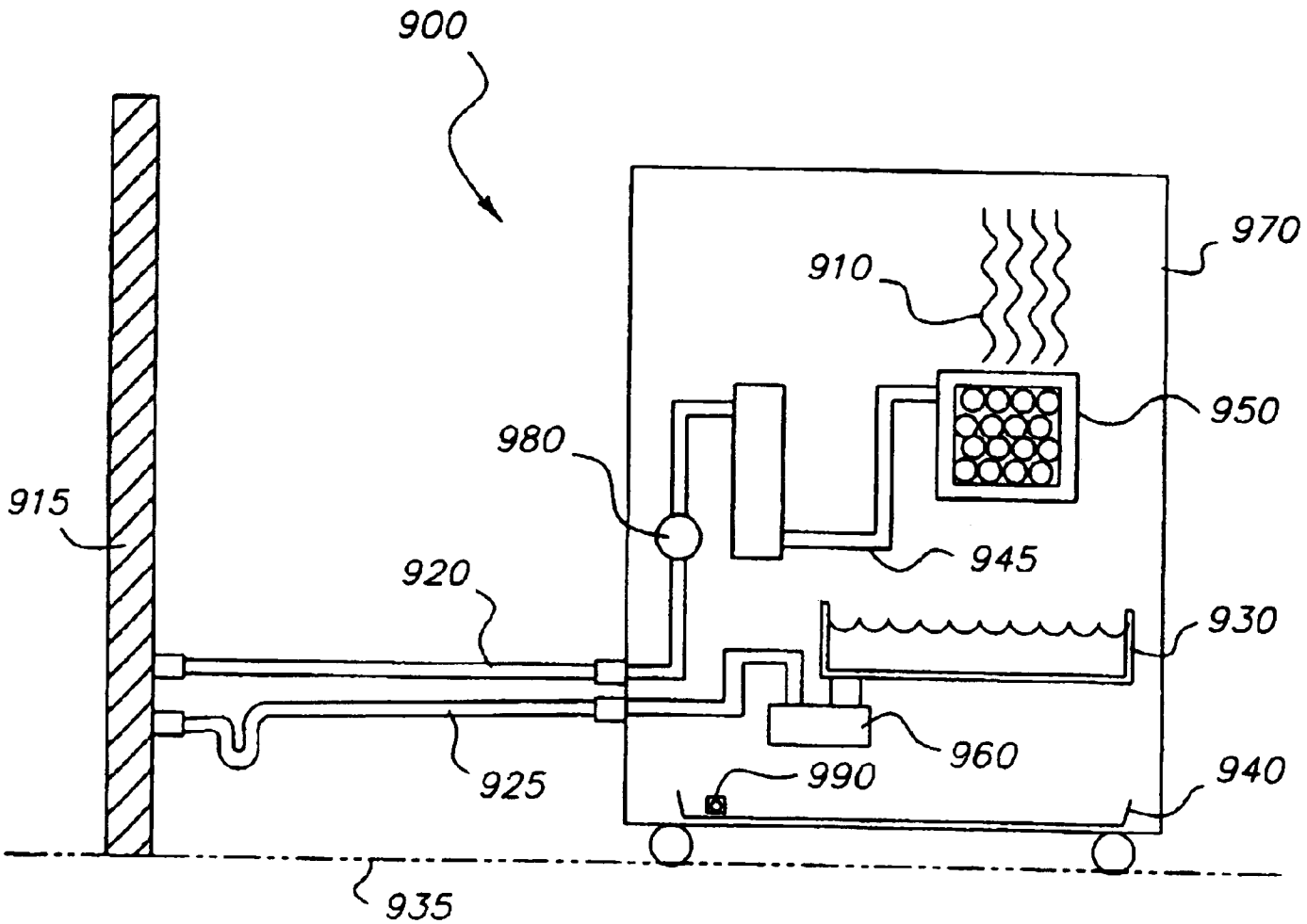
FIG. 9 schematically shows an arrangement for supplying water for purpose of humidification in an air-conditioning device of an air quality management apparatus of the invention.

FIG. 9 schematically shows a preferred humidification system 900 for supplying water for purpose of humidification by an RH unit included in an air-conditioning device of an air quality management apparatus of the invention. Main water flows as required from a fitting in wall 915 through a water supply line 920 into an air-conditioning device 970. Certain elements relating to humidification are indicated within device 970, which is shown as a castered walled unit resting on a floor 935. Water flowing from water supply line 920 flows through water filter 910 and then passes on to a humidifier 950. Excess water from the humidifier 950 falls into drain pan 930 and is pumped by pump 960 into water drain line 925. Preferably, humidifier 950 includes a humidification device similar to device 800 of FIG. 8, except for the drain pan 830. Flow of water through a valve 980 is controlled by signals sent by an RH controller (not shown) to a valve control mechanism (not shown) for controlling humidification by the humidifier 950, as described with reference to FIG. 8. Valve 980, shown upstream of water filter 910 in FIG. 8, may alternatively be located in tubing 945 between filter 910 and humidifier 950. Water dripping off a wettable pad in humidifier 950, i.e., from a pad such as pad 810 of FIG. 8, drips into drain 930. Also, water condensate may drip off the evaporator coil included in air-conditioning device 970 and be collected by the drain pan 930 (the evaporator coil, such as for example coil 330 of FIG. 3A, is not shown in FIG. 8).

A base pan 940 is included in arrangement 900 for purpose of catching water in case of a failure of water circulation, for example by a blockage of water drain line 925, by a blockage of the exit from drain pan 930, or by a failure of pump 960. Such a failure would result in a failure of humidification control by the air-conditioning device 970, as well as possible flooding by an overflow of base pan 940. In a preferred embodiment, at least one water-sensitive sensor 990 is provided located in base pan 940. In the event of water being detected by sensor 990, a signal is sent to the valve control mechanism which shuts valve 980. This signal also initiates a "Cooling Without Humidification" mode of operation of air-conditioning device 970.

In the "Cooling Without Humidification" mode of operation, refrigerant is sporadically flowed by a refrigerant circulation mechanism (not shown in FIG. 9) through the evaporator coil (not shown), i.e., at a reduced duty cycle. Preferably, refrigerant is flowed less than about 10% of the time, i.e., the duty cycle is preferably less than about 10%. More preferably, the duty cycle is less than 5%. By comparison, the duty cycle in air-conditioning unit 300 of FIG. 3A is preferably 100%. A reduced duty cycle can nevertheless typically maintain the temperature of conditioned air, i.e., air leaving device 970 for recirculation, at a temperature close to the target temperature. This is because typical cooling by the evaporator coil entails a very light cooling load as compared with the heavy cooling load imposed by typical dehumidification of moist air entering the device 970, i.e., for conditioning and recirculation. In the "Cooling Without Humidification" mode of operation, the refrigerant, having passed through the evaporator coil, is diverted by a valve, e.g., a 3-way valve, into a shunt pipe or tube and flowed directly back to the condenser coil (this valve and shunt pipe not shown in FIG. 3A). In air-conditioning device 970, which device typically includes elements and components similar to those shown in device 300 of FIG. 3A, this shunt pipe bypasses the pressure regulator as well as the compressor (e.g., PR 335 and compressor 340 of FIG. 3A). In experimental tests using arrangement 900, it has been found that usable color prints can be made in a printer in which air-conditioning device 970 is operated in the "Cooling Without Humidification" mode. Usable electrophotographic prints on paper can be made if the temperature and RH of the ambient air surrounding the printer are close to values typically found inside a building, e.g., close to 21° C. (70° F.) and 50% RH, and under such conditions (without control relative of humidity) a target temperature of about 21° C. was maintained.

The present invention has certain advantages over prior art, listed below.

One advantage is that substantially all excess heat generated by the printer machine is not radiated or convected to the room in which the machine is housed, but is sent by the air quality control apparatus of the invention as an outflow for disposal at a location outside the machine, such as to an HVAC system. Thus the operation of the air quality management apparatus advantageously does not rely on heat exchange with ambient room air, such as for example in the apparatus of the Lotz patent (U.S. Pat. No. 5,056,331).

Another advantage of the present invention is that airflow rates through the first interior volume are large. The large airflow rates substantially prevent fuser oil volatiles from reaching susceptible components in the machine, which susceptible components include for example the image-forming modules, members included in the modules, and members included in the auxiliary chambers associated with the modules. In the de Cock et al. patent (U.S. Pat. No. 5,481,339), a relatively small airflow rate of about 71 cubic feet per minute is moved by the main blower, which airflow is recirculated to ten image-forming modules included in a duplex continuous sheet printer. By contrast, approximately 33 times as much air is moved through both of the open-loop and recirculation portions of the air quality management apparatus 700 of the present invention.

Moreover, in the printer disclosed in the de Cock et al. patent (U.S. Pat. No. 5,481,339), sensing of relative humidity and temperature of air being recirculated through an air-conditioning apparatus is done by sensors located upstream of the air-conditioning apparatus. In the present invention, relative humidity and temperature sensors are advantageously located downstream of any air-conditioning, i.e., near exit(s) of the devices 300, 400, and 500 of FIGS. 3A, 4, and 5, respectively. Because both temperature and relative humidity of air entering an air-conditioning device can be considerably and unpredictably altered after passage through the air-conditioning device, the present positioning of the relative humidity and temperature sensors at locations downstream from temperature-conditioning and relative-humidity-conditioning apparatus is superior, and results in more stably controlled temperature and relative humidity of air leaving the air-conditioning device than is possible by the apparatus of the de Cock et al. patent (U.S. Pat. No. 5,481,339).

The present invention has yet another advantage, in that the modules and the associated auxiliary chambers included in the printer are each provided with conditioned air such that each module and each auxiliary chamber may be maintained at a similar nominal temperature. In addition, the large airflow through the first interior volume provides a relatively uniform temperature within the first interior volume. The frame of the printer, which is typically made of metal, is therefore subjected to only small heat-related stresses, e.g., such as would otherwise be caused by locally differing heat generation rates by the various heat generating devices included in the printer, or by a thermal gradient in the ambient air surrounding the printer. As a result, any bending or twisting of the frame is minimized, which is important for maintaining high mechanical tolerances needed for proper operation of the modules.

In the above description of the invention, at least one air moving device is disclosed for moving a specified total airflow rate through the first interior volume via a plurality of throughput pathways, and at least one air recirculation device is disclosed for recirculating a specified total rate of recirculation of air through a plurality of recirculation pathways in the second interior volume. Notwithstanding these disclosures, both the specified total airflow rate through the first interior volume and the specified total rate of recirculation may be varied from time to time as may be necessary, e.g., during operation of the printer or between print runs. Moreover, apparatus (not illustrated) may be provided for altering, e.g., in real time, proportional amounts of air flowing in certain ones of the plurality of throughput pathways, or in certain ones of the plurality of recirculation pathways.

An improvement of the present invention over the apparatus of the Hoffman et al. patent (U.S. Pat. No. 5,819,137) is that a sound-absorbing labyrinth for suppressing noise associated with large airflow throughput rates is not needed.

The invention has been described in detail with particular reference to certain preferred embodiments thereof, but it will be understood that variations and modifications can be effected within the spirit and scope of the invention.

What is claimed is:

1. An air quality management apparatus, for use in an electrostatographic printer for making color images on receiver members, which printer has a paper conditioning station associated therewith and which printer includes a first interior volume and a second interior volume, which first interior volume includes a fusing station for fusing said color images on said receiver members, which second interior volume includes a number of tandemly arranged electrostatographic image-forming modules, said second interior volume also including charging devices, image writers, toning stations and cleaning stations operating in conjunction with said electrostatographic image-forming modules, said second interior volume differentiated from said first interior volume by at least one separating member, said air quality management apparatus comprising:

an open-loop portion for managing of an air quality of air flowing through and included in said first interior volume, which first interior volume is provided with at least one inlet port and at least one outlet port, said first interior volume including a plurality of throughput pathways connecting said at least one inlet port with said at least one outlet port, said open-loop portion including at least one air moving device for drawing ambient air from outside of said printer through said at least one inlet port to said first interior volume and moving said air included in said first interior volume towards and through said at least one outlet port for expulsion as expelled air, said at least one air moving device providing a specified total airflow rate between said at least one inlet port and said at least one outlet port;

a recirculation portion for managing of an air quality of air included in and circulating within said second interior volume, said recirculation portion including an air-conditioning device having an entrance and at least one exit, each of said at least one exit providing a respective post-exit airflow included in at least one post-exit airflow, which air-conditioning device provides conditioning of said air included in said second interior volume, said recirculation portion of said air quality management apparatus further including at least one air recirculation device, said at least one air recirculation device for moving said air included in said second interior volume at a specified total rate of recirculation through said air-conditioning device, such that air-conditioned air leaving said at least one exit of said air-conditioning device is urged by said at least one air recirculation device through a plurality of recirculation pathways included in said second interior volume, said plurality of pathways included in said second interior volume being conjoined into a common duct for carrying air for recycling to a filtering unit, said filtering unit located within, said common duct, said filtering unit for removing contaminants from said air for recycling in said air-conditioning device;

wherein, excepting said at least one inlet port to said first interior volume and said at least one outlet port from said first interior volume, said first interior volume and said second interior volume are substantially sealed from said ambient air outside of said printer;

wherein said expelled air carries out, from said first interior volume, excess heat and aerial contamination generated within said first interior volume;

wherein said recirculation portion of said air quality management apparatus includes at least one mechanism for removing, during said recycling, aerial contaminants from said air included within said second interior volume;

wherein said conditioning and recycling by said air-conditioning device includes a temperature controller for temperature control, within a predetermined temperature range, of said at least one post-exit airflow from said air-conditioning device; and wherein said conditioning and recycling by said air-conditioning device includes a relative humidity controller for relative humidity control, within a predetermined relative humidity range, of said at least one post-exit airflow from said air-conditioning device.

2. The air quality management apparatus according to claim 1, wherein said at least one separating member defines at least one leakage pathway between said first interior volume and said second interior volume, said at least one leakage pathway associated with a leakage flow rate of air from said first interior volume to said second interior volume and a substantially equal leakage flow rate of air from said second interior volume to said first interior volume, which leakage flow rate from said second interior volume to said first interior volume is a predetermined fraction of said specified total rate of recirculation within said recirculation portion of said air quality management apparatus.

3. The air quality management apparatus according to claim 2, wherein said predetermined fraction is less than about 0.33.

4. The air quality management apparatus according to claim 3, wherein said predetermined fraction includes substantially zero.

5. The air quality management apparatus according to claim 2, wherein said at least one separating member comprises a transport web for transporting said receiver members past said number of tandemly arranged electrostatographic image-forming modules.

6. The air quality management apparatus according to claim 5, wherein said transport web has a form of a tube encircling a third interior volume, said third interior volume communicating with said at least one leakage pathway, said communicating thereby resulting in a formation within said third interior volume of a mixed air, said mixed air having characteristics intermediate between characteristics of said air included in said first interior volume and characteristics of said air included in said second interior volume, said characteristics including temperature and relative humidity.

7. The air quality management apparatus according to claim 1, wherein said aerial contamination carried out from said first interior volume by said expelled air includes at least one of a group of contaminants, said group of contaminants comprising: amines, acrolein, ozone, fuser oil vapor, water vapor, and particulates.

8. The air quality management apparatus according to claim 1, wherein a device is provided for purpose of directing, at a specified input rate, a refreshing flow of filtered air from outside said printer into said second interior volume through at least one input pipe, with a compensating airflow rate of approximately equal magnitude to said specified input rate leaving said second interior volume to at least one location outside said second interior volume.

9. The air quality management apparatus according to claim 8, wherein said specified input rate divided by said total recirculation rate is less than about 0.2.

10. The air quality management apparatus according to claim 9, wherein said specified input rate divided by said total recirculation rate is less than about 0.05.

11. The air quality management apparatus according to claim 1, wherein in associative proximity to each said at least one inlet port is provided an amine filter, which amine filter is for a purpose of removing amine contaminants from said ambient air entering said first interior volume through said at least one inlet port.

12. The air quality management apparatus according to claim 1, wherein in associative proximity to each said at least one inlet port is provided a particulate filter for a purpose of removing particulate contaminants from said ambient air entering said first interior volume through said at least one inlet port.

13. The air quality management apparatus according to claim 1, wherein said recirculation portion includes at least one device for removing ozone from said air included in said second interior volume.

14. The air quality management apparatus according to claim 1, wherein said recirculation portion includes at least one coarse particulate filter for removing coarse particles from said air included in said second interior volume, said at least one coarse particulate filter included in said filtering unit.

15. The air quality management apparatus according to claim 1, wherein said recirculation portion includes at least one fine particulate filter for removing fine particles from said air included in said second interior volume, said at least one fine particulate filter included in said filtering unit.

16. The air quality management apparatus according to claim 1, wherein said expelled air is led through a duct connecting said at least one outlet port to an external mechanism for air disposal.

17. The air quality management apparatus according to claim 1, wherein said number of tandemly arranged electrostatographic image-forming modules is five and said specified total airflow rate through said first interior volume is approximately 1180 cubic feet per minute±200 cubic feet per minute.

18. The air quality management apparatus according to claim 1, wherein said number of tandemly arranged electrostatographic image-forming modules is five and said specified total rate of recirculation of said air included in said second interior volume is approximately 1180 cubic feet per minute, which specified total rate of recirculation is included in a range between approximately 1080 cubic feet per minute and 1380 cubic feet per minute.

19. The air quality management apparatus according to claim 1, wherein air recirculated to said air-conditioning device for said conditioning has had coarse and fine particulates removed therefrom by said filtering unit, which air is divided into a first stream and a second stream, said first stream cooled by flowing past cooling fins for cooling said first stream, said cooling fins in thermal contact with an evaporator coil, said evaporator coil in the form of a thermally conductive tube containing a refrigerant being passed in the form of a cold gas/liquid mixture through the interior of said tube, said cooling fins being thermally conductive and thereby cooled by said evaporator coil in thermal contact with said cold gas/liquid mixture, whereinafter having moved past said evaporator coil, said first stream is mixed with said second stream to form a recombined stream, which recombined stream is flowed in a primary duct through an internal filtering unit, which internal filtering unit includes in order of flow-through an ozone filter and an amine filter, which combined stream after being filtered of ozone and amines passes by thermally conductive heating fins for heating said recombined stream, said thermally conductive heating tins being in thermal contact with a reheat coil, said reheat coil for intermittent use for intermittently heating said recombined stream, wherein during said intermittent use a flow of said refrigerant in the form of a hot compressed gas is passed through said reheat coil, said reheat coil being a thermally conductive tube containing said refrigerant, said intermittent use for intermittently heating said recombined stream controlled by said temperature controller.

20. The air quality management apparatus according to claim 19, wherein in said air-conditioning device said recombined stream, after passing said reheat coil, is flowed through a humidification unit for intermittently humidifying said recombined stream and from thence through a main recirculation device, whereinafter said recombined stream is sensed by a temperature sensor for sensing a temperature of said recombined stream and by a relative humidity sensor for sensing a relative humidity of said recombined stream, said temperature sensor connected to said temperature controller and said relative humidity sensor connected to said relative humidity controller, said recombined stream thereafter divided as necessary for flowing through said at least one exit from said air-conditioning device.

21. The air quality management apparatus according to claim 20, wherein said temperature of said recombined stream sensed by said temperature sensor is kept within a predetermined temperature range having a lowest temperature and a highest temperature, said intermittent use for intermittently heating said recombined stream comprising an activation by a turn-on signal from said temperature controller when said temperature of said recombined stream as sensed by said temperature sensor is lower than a target temperature, said intermittent use for intermittently heating said recombined stream further comprising a deactivation by a turn-off signal from said temperature controller when said temperature of said recombined stream being sensed by said temperature sensor is higher than said target temperature, which target temperature is approximately midway between said lowest temperature and said highest temperature.

22. The air quality management apparatus according to claim 21, wherein said turn-on signal activates a solenoid valve, which solenoid valve thereby opens a gate for flowing said refrigerant in the form of said hot compressed gas through said reheat coil, and wherein said turn-off signal activates said solenoid valve to close said gate, thereby stopping said flowing of said refrigerant through said reheat coil.

23. The air quality management apparatus according to claim 22, wherein said lowest temperature is approximately 20.0° C. and said highest temperature is approximately 22.2° C.

24. The air quality management apparatus according to claim 20, wherein said relative humidity of said recombined stream sensed by said relative humidity sensor is maintained within a predetermined relative humidity range by an intermittent use of said humidification unit, said predetermined relative humidity range having a lowest relative humidity and a highest relative humidity, said intermittent use of said humidification unit comprising an activation by a turn-on signal from said relative humidity controller when said relative humidity of said recombined stream as sensed by said relative humidity sensor is lower than a target relative humidity, said intermittent use of said humidification unit further comprising a deactivation by a turn-off signal from said relative humidity controller when said relative humidity of said recombined stream being sensed by said relative humidity sensor is higher than said target relative humidity, which target relative humidity is approximately midway between said lowest relative humidity and said highest relative humidity.

25. The air quality management apparatus according to claim 24, wherein said lowest relative humidity is approximately 30 percent and said highest relative humidity is approximately 40 percent.

26. The air quality management apparatus according to claim 20, said humidification unit comprising a drip mechanism and a wettable pad for use with said drip mechanism, wherein said activation causes said drip mechanism to drip water on to said wettable pad so as to maintain thereby a wetness of said wettable pad, said recombined stream being humidified during said activation by flowing past and contacting said wetness, said deactivation preventing said water from being dripped on to said wettable pad and said wetness not maintained.

27. The air quality management apparatus according to claim 26, said humidification unit further comprising a collection mechanism for collecting excess water dripping from said wettable pad and a pumping mechanism for recycling said excess water for return to said drip mechanism.

28. The air quality management apparatus according to claim 19, said recombined stream flowed from a continuation of said primary duct into at least one secondary duct, each said at least one secondary duct carrying a respective subflow of said recombined stream, said respective subflow flowing through a respective humidification unit for intermittent use for intermittently humidifying said respective subflow, said respective subflow sensed after passing said respective humidification unit by a respective temperature sensor and by a respective relative humidity sensor, said respective temperature sensor connected to said temperature controller and said respective relative humidity sensor connected to said relative humidity controller, said respective subflow moving toward a respective exit included in said at least one exit from said air-conditioning device, from which respective exit is flowed a respective post-exit subflow, said respective post-exit subflow providing a respective individually air-conditioned air, wherein said temperature of said respective post-exit subflow is continuously sensed as a respective temperature signal by said respective temperature sensor, each said respective temperature signal being utilized at any instant in said temperature controller by an algorithm to calculate a control temperature, said control temperature calculated according to said algorithm being dependent on each said respective temperature signal, said control temperature maintained within a predetermined temperature range bounded by a lowest temperature and a highest temperature, said intermittent use for intermittently heating said recombined stream comprising an activation by a turn-on signal from said temperature controller when said control temperature is lower than a target control temperature, said intermittent use for intermittently heating said recombined stream further comprising a deactivation by a turn-off signal from said temperature controller when said control temperature is higher than said target control temperature, which target temperature is approximately midway between said lowest temperature and said highest temperature; and wherein said relative humidity of said respective post-exit subflow is continuously sensed as a respective relative humidity signal by said respective relative humidity sensor, said intermittent use for intermittently humidifying said respective subflow according to signals sent to said respective humidification unit from said humidity controller, said relative humidity controller being preset so as to maintain for each respective post-exit subflow a respective relative humidity, which respective relative humidity lies within a respective predetermined relative humidity range for said respective post-exit subflow, said respective predetermined relative humidity range bounded by a respective lowest relative humidity and a respective highest relative humidity, wherein in response to a respective turn-on signal from said humidity controller, a respective activation of said respective humidification unit by said relative humidity controller starts a respective active humidification of said respective subflow when said respective relative humidity is lower than a respective target relative humidity, and in response to a respective turn-off signal from said humidity controller, a respective deactivation of said respective humidification unit by said relative humidity controller stops said active humidification when said respective relative humidity is higher than said respective target relative humidity, said respective target relative humidity being approximately midway between said respective lowest relative humidity and said respective highest relative humidity.

29. The air quality management apparatus according to claim 19, wherein said recombined stream is flowed past an auxiliary post-reheat temperature sensor and then through a continuation of said primary duct into at least one secondary duct, each said at least one secondary duct carrying a respective subflow of said recombined stream, said respective subflow flowing past a respective temperature adjusting mechanism and through a respective humidification unit, said respective temperature adjusting mechanism and respective humidification unit arranged in a given order, said respective temperature adjusting mechanism for intermittent usage for adjusting a temperature of said respective subflow, said respective humidification unit for intermittent use for intermittently humidifying said respective subflow, said respective subflow sensed, after passing said respective temperature adjusting mechanism and said respective humidification unit, by a respective temperature sensor and by a respective relative humidity sensor, said respective temperature sensor connected to said temperature controller and said respective relative humidity sensor connected to said relative humidity controller, said respective subflow moving toward a respective exit included in said at least one exit from said air-conditioning device, from which respective exit is flowed a respective post-exit subflow, which respective post-exit subflow has a respective individual temperature and a respective individual relative humidity;

wherein said relative humidity of said respective post-exit subflow is continuously sensed as a respective relative humidity signal by said respective relative humidity sensor, said intermittent use for intermittently humidifying said respective subflow according to signals sent to said respective humidification unit from said humidity controller, said relative humidity controller being preset so as to maintain for each respective post-exit subflow a respective relative humidity, which respective relative humidity lies within a respective predetermined relative humidity range for said respective post-exit subflow, said respective predetermined relative humidity range bounded by a respective lowest relative humidity and a respective highest relative humidity, wherein in response to a respective turn-on signal from said humidity controller, a respective activation of said respective humidification unit by said relative humidity controller starts a respective active humidification of said respective subflow when said respective relative humidity is lower than a respective target relative humidity, and in response to a respective turn-off signal from said humidity controller, a respective deactivation of said respective humidification unit by said relative humidity controller stops said active humidification when said respective relative humidity is higher than said respective target relative humidity, said respective target relative humidity being approximately midway between said respective lowest relative humidity and said respective highest relative humidity; and wherein said temperature of said recombined stream sensed by said auxiliary post-reheat temperature sensor is kept within a predetermined post-reheat temperature range bounded by a least post-reheat temperature and an uppermost post-reheat temperature, said intermittent use for intermittently heating said recombined stream activated by a turn-on signal from said temperature controller when said temperature of said recombined stream sensed by said auxiliary post-reheat temperature sensor is lower than a target post-reheat temperature, said intermittent use for intermittently heating said recombined stream deactivated by a turn-off signal from said temperature controller when said temperature of said recombined stream sensed by said auxiliary post-reheat temperature sensor is higher than said target post-reheat temperature, which target post-reheat temperature is approximately midway between said least post-reheat temperature and said uppermost post-reheat temperature, and, wherein said intermittent usage for adjusting a temperature of said respective subflow is controlled according to respective signals sent to each said respective temperature adjusting mechanism from said temperature controller, said temperature controller being preset so as to maintain for each respective post-exit subflow a respective post-exit subflow temperature, which respective post-exit subflow temperature lies within a respective predetermined temperature range for said respective post-exit airflow, said respective predetermined temperature range for said respective post-exit airflow bounded by a respective lowest temperature and a respective highest temperature, wherein in response to a respective activation signal from said temperature controller, a respective activation of said respective temperature adjusting mechanism by said temperature controller produces a respective alteration of said respective post-exit subflow temperature, and in response to a respective deactivation signal from said temperature controller, a respective deactivation of said respective temperature adjusting mechanism by said relative temperature controller causes said respective alteration of said respective subflow temperature to cease, said respective activation of said respective temperature adjusting mechanism by said respective activation signal taking place when said respective temperature sensor senses a respective post-exit subflow temperature that differs from a respective target post-exit subflow temperature for said respective post-exit subflow, said respective activation ceased by said deactivation signal when said respective post-exit subflow temperature is approximately equal to said respective target post-exit subflow temperature, which respective target post-exit subflow temperature is approximately midway between said respective lowest temperature and said respective highest temperature.

30. The air quality management apparatus according to claim 29, wherein said turn-on signal activates a solenoid valve, which solenoid valve thereby opens a gate for flowing said refrigerant in the form of said hot compressed gas through said reheat coil, and wherein said turn-off signal activates said solenoid valve to close said gate, thereby stopping said flowing of said refrigerant through said reheat coil.

31. The air quality management apparatus according to claim 19, said first stream having an airflow rate V1 and said second stream having an airflow rate V2, wherein a ratio equal to V1 divided by V2 is a fixed ratio during operation of said air quality management apparatus.

32. The air quality management apparatus according to claim 31, wherein said fixed ratio is approximately 0.77±0.20.

33. The air quality management apparatus according to claim 19, said first stream having an airflow rate V1 and said second stream having an airflow rate V2, wherein a ratio equal to V1 divided by V2 is a controllably adjustable ratio during operation of said air quality management apparatus.

34. The air quality management apparatus according to claim 19, said printer further including a fourth interior volume, said air-conditioning device encompassing said fourth interior volume, said fourth interior volume distinct from each of said first interior volume and said second interior volume, said air conditioning device including a closed-loop circuit for flowing a refrigerant through successive devices included in said closed-loop circuit, said refrigerant being circulated as a refrigerant flow by a refrigerant circulation mechanism, said successive devices through which said refrigerant being circulated comprising:

said evaporator coil, included in said second interior volume, in which said evaporator coil said refrigerant is evaporated from a liquid state to form a refrigerant gas;

a pressure regulator, located downstream from said evaporator coil, said pressure regulator included in said second interior volume;

a compressor, located downstream from said evaporator coil, said compressor for compressing said refrigerant gas to a compressed refrigerant gas, said compressor included in said second interior volume;

a gate, located downstream from said compressor, said gate for dividing said refrigerant flow into a main refrigerant flow and an intermittent auxiliary refrigerant flow, said gate activated by a solenoid valve for intermittently flowing said intermittent auxiliary refrigerant flow through said reheat coil, said gate included in said second interior volume;

a condenser coil, said condenser coil included in said fourth interior volume, said condenser coil located downstream from said gate and downstream from said reheat coil, to which said condenser coil said main refrigerant flow and said intermittent auxiliary refrigerant flow are together flowed, said condenser coil for cooling and thereby at least partially condensing said compressed refrigerant gas to said liquid state;

an expansion valve located downstream from said condenser coil, said expansion valve included in said second interior volume; and wherein ambient air is drawn as an ambient input airflow from outside said printer through an inlet into said fourth interior volume by an air moving device, said inlet provided with an entry filter, said ambient input airflow directed through an air compressor for compressing said ambient input airflow, said air compressor included in said fourth interior volume, said ambient input airflow subsequently flowed past thermally conductive cooling fins, said thermally conductive cooling fins in thermal contact with said condenser coil, such that heat absorbed by said ambient input airflow from said refrigerant within said condenser coil causes said compressed airflow to become a heated airflow, which heated airflow after flowing past said condenser coil is passed through an exit duct leading from said fourth interior volume to a location for disposal outside of said printer.

35. The air quality management apparatus according to claim 34, wherein said respective inlet port filter and said entry filter are high throughput filters for filtering airborne particles from said ambient air entering respectively said first interior volume and said fourth interior volume, said high throughput filters similar to commercial residential furnace filters.

36. The air quality management apparatus according to claim 35, wherein said ambient inlet air flow into said fourth interior volume is about at least 1250 cubic feet per minute.

37. The air quality management apparatus according to claim 35, wherein said refrigerant comprises at least one fluorohydrocarbon.

38. The air quality management apparatus according to claim 37, wherein said at least one fluorohydrocarbon is a mixture of about 50 percent by weight difluoromethane and about 50 percent by weight pentafluoroethane.

39. The air quality management apparatus according to claim 34, said air moving device being a blower for blowing said mixture through said exit duct, wherein said blower provides a first Suction for drawing said ambient air into said fourth interior volume, and wherein said blower applies a second suction to said one or air from outside of said printer through said at least one inlet port into said first interior more outlet ports from said first interior volume, said second suction for drawing ambient air from outside of said printer through said at least one inlet port into said first interior volume, each said at least one inlet port provided with a respective inlet port filter.

40. The air quality management apparatus according to claim 34 wherein said refrigerant circulation mechanism is operated for sporadically flowing said refrigerant through said evaporator coil at a duty cycle of less than about 10%, and wherein said refrigerant, having passed through said evaporator coil, is diverted by a valve into a shunt pipe and flowed directly to said condenser coil, said shunt pipe bypassing said pressure regulator as well as said compressor, said sporadically flowing said refrigerant made to occur when operation of a humidification system for humidifying said air-conditioned air experiences an operational failure, said humidification system for operation in conjunction with said air-conditioning device.

41. The air quality management apparatus according to claim 40, wherein said duty cycle is less than about 5%.

42. The air quality management apparatus according to claim 19, said printer further including a fourth interior volume, said air-conditioning device encompassing said fourth interior volume, said fourth interior volume distinct from each of said first interior volume and said second interior volume, said air conditioning device including a closed-loop circuit for flowing a refrigerant through successive devices included in said closed-loop circuit, said refrigerant being circulated as a refrigerant flow by a refrigerant circulation mechanism, said successive devices through which said refrigerant being circulated comprising:

an evaporator coil, said evaporator coil included in said second interior volume, in which said evaporator coil said refrigerant is evaporated from a liquid state to form a refrigerant gas;

a pressure regulator, located downstream from said evaporator coil, said pressure regulator included in said second interior volume;

a compressor, located downstream from said evaporator coil, said compressor for compressing said refrigerant gas to a compressed refrigerant gas, said compressor included in said second interior volume;

a gate, located downstream from said compressor, said gate for dividing said refrigerant flow into a main refrigerant flow and a controlled auxiliary refrigerant flow, said gate activated by a 3-way continuously variable valve for controllably flowing said controlled auxiliary refrigerant flow through said reheat coil, said gate included in said second interior volume;

a condenser coil, said condenser coil included in said fourth interior volume, said condenser coil located downstream from said gate and downstream from said reheat coil, to which said condenser coil said main refrigerant flow and said intermittent auxiliary refrigerant flow are together flowed, said condenser coil for cooling and thereby at least partially condensing said compressed refrigerant gas to said liquid state;

an expansion valve located downstream from said condenser coil, said expansion valve included in said second interior volume; and wherein ambient air is drawn as an ambient input airflow from outside said printer through an inlet into said fourth interior volume by an air moving device, said inlet provided with an entry filter, said ambient input airflow directed through an air compressor for compressing said ambient input airflow, said air compressor included in said fourth interior volume, said ambient input airflow subsequently flowed past thermally conductive cooling fins, said thermally conductive cooling fins in thermal contact with said condenser coil, such that heat absorbed by said ambient input airflow from said refrigerant within said condenser coil causes said compressed airflow to become a heated airflow, which heated airflow after flowing past said condenser coil is passed through an exit duct leading from said fourth interior volume to a location for disposal outside of said printer.

43. The air quality management apparatus according to claim 1, wherein certain ones of said at least one post-exit airflow are provided with respective pipes, each of which respective pipes for delivering from said air-conditioning device a respective individually air-conditioned post-exit airflow to a respective toning station, thereby individually controlling a respective local temperature and a respective local relative humidity in the vicinity of said respective toning station.

44. The air quality management apparatus according to claim 1, wherein said at least one post-exit airflow provides module-ventilating air-conditioned air transported via ductage to a module-supplying input manifold provided with output pipes, through which said output pipes said module-ventilating air-conditioned air is delivered in approximately equal module-ventilating flows for respectively bathing each of said number of tandemly arranged electrostatographic image-forming modules, and wherein a respective exhaust pipe leads a respective module-exhausting outflow away from each of said image-forming modules to a module-exhausting output manifold, and from said module-exhausting output manifold for recirculation to said air-conditioning device.

45. The air quality management apparatus according to claim 1, wherein said at least one post-exit airflow provides subsystem-ventilating air-conditioned air transported via ductage to a subsystem-supplying input manifold, from which subsystem-supplying input manifold said subsystem-ventilating air-conditioned air is respectively piped in approximately equal subsystem flows to each of said number of tandemly arranged electrostatographic image-forming modules, a respective subsystem flow divided into a respective charger-related portion of flow and a respective image-writer-related portion of flow, said respective charger-related portion of flow for ventilating at least one charging device in a respective image-forming module, and said respective image-writer-related portion of flow for cooling a respective image writer located in said respective image-forming module.

46. The air quality management apparatus according to claim 1, wherein in a respective module a toning-station-related airflow is moved by said at least one air recirculation device into a developer-dust-removal duct included in said respective module, said developer-dust-removal duct being in associative proximity to a respective toning station included in said toning stations, said toning station generating a developer dust, which developer dust is entrained within said toning-station-related airflow for movement for movement via ducted passage to a particulate-related output manifold, and from said particulate-related output manifold for further movement by said at least one air recirculation device through an auxiliary developer dust filter, and from thence for recirculation to said air-conditioning device, said at least one air recirculation device including an auxiliary suction device for augmenting said further movement.

47. The air quality management apparatus according to claim 1, wherein in a respective module a cleaning-station-related airflow is moved by said at least one air recirculation device into a cleaning-station-debris-removal duct included in said respective module, said cleaning-station-debris-removal duct being in associative proximity to a cleaning station included in said cleaning stations, said cleaning station generating a cleaning station debris, which cleaning station debris is entrained within said cleaning-station-related airflow for movement via ducted passage to a particulate-related output manifold, and from said particulate-related output manifold for further movement by said at least one air recirculation device through an auxiliary cleaning station debris filter, and from thence for recirculation to said air-conditioning device, said at least one air recirculation device including an auxiliary suction device for augmenting said further movement.

48. The air quality management apparatus according to claim 1, wherein associated with a respective module included in said number of tandemly arranged electrostatographic image-forming modules is an adjoining respective auxiliary chamber, said auxiliary chamber included in a plurality of auxiliary chambers in one-to-one relationship with said modules, said respective auxiliary chamber containing heat generating devices for operating said respective module, and which heat generating devices include: drive motors for rotating rotatable members included in said respective modules, power supplies, and circuit boards.

49. The air quality management apparatus according to claim 48, wherein said at least one post-exit airflow provides auxiliary-chamber-ventilating air transported via ductage to an input manifold for ventilation of said plurality of auxiliary chambers, said input manifold for ventilation for delivering approximately equal auxiliary-chamber-input airflows to each auxiliary chamber of said plurality of auxiliary chambers, said input manifold for ventilation providing a piping connection to each said auxiliary chamber for transporting said auxiliary-chamber-ventilating air to said plurality of auxiliary chambers, and wherein an exhaust pipe from each said auxiliary chamber carries an auxiliary-chamber-exhausting airflow away from each said auxiliary chamber to an auxiliary-chamber-exhausting output manifold, and thence from said auxiliary-chamber-exhausting output manifold to said filtering unit.

50. The air quality management apparatus according to claim 1, wherein said at least one air moving device included in said open-loop portion is chosen from a group including blowers, fans, and air Suction mechanisms.

51. The air quality management apparatus according to claim 1, wherein said at least one air recirculation device included in said recirculation portion is chosen from a group including blowers, fans, and air suction mechanisms.

52. The air quality management apparatus according to claim 1, wherein said specified total airflow rate of air managed in said open-loop portion and said specified total rate of recirculation of air managed in said recirculation portion differ by less than 5 percent from one another.

53. The air quality management apparatus according to claim 1, wherein both the specified total airflow rate and the specified total rate of recirculation are reduced to stand-by values wherein said electrostatographic printer is in stand-by mode, so as to maintain said temperature control within said predetermined temperature range and to maintain said relative humidity control within said predetermined relative humidity range during stand-by mode.

54. The air quality management apparatus according to claim 1, wherein at least one airflow rate of air included in said first interior volume and flowing through said plurality of throughput pathways is individually adjustable during operation of said electrostatographic printer.

55. The air quality management apparatus according to claim 1, wherein at least one airflow rate of said air-conditioned air flowing through said plurality of recirculation pathways is individually adjustable during operation of said electrostatographic printer.

56. The air quality management apparatus according to claim 1, wherein a percentage of one of said at least one post-exit airflow is divided into individual flows, each of said individual flows respectively flowing for delivery directly to certain ones of said charging devices for purpose of ventilating said certain ones of said charging devices, said individual flows subsequently flowing back for recirculation by said air-conditioning device.

57. The air quality management apparatus according to claim 1, wherein said filtering unit includes a plurality of filters, said filters arranged in a predetermined order for a sequential passage through said filters of said air for recycling, said plurality of filters including at least one of the following filters listed in said predetermined order: a coarse particulate filter, a fine particulate filter, an ozone filter, and an amine filter.

58. The air quality management apparatus according to claim 1, said paper conditioning station included in said first interior volume, and wherein said plurality of pathways connecting said at least one inlet port with said at least one outlet port in said open-loop portion includes the following pathways:

a pathway through a post fuser cooler, associated with said fusing station, for cooling said color images on said receiver members after fusing said color images on said receiver members in said fusing station, said pathway through a post fuser cooler including a cooling auxiliary fan;

a pathway through a paper cooler, said pathway through a paper cooler including a pre-cooling auxiliary fan and a post-cooling auxiliary fan, said paper cooler included in said paper conditioning station included in said first interior volume;

a pathway through a paper heater, said paper heater included in said paper conditioning station included in said first interior volume; and one or more pathways through frame portions of said printer, said frame portions included in said first interior volume.

59. The air quality management apparatus according to claim 58, wherein said managing of an air quality of air flowing through and included in said first interior volume includes removal of heat, generated within said first interior volume, by said air flowing through and included in said first interior volume.

60. The air quality management apparatus according to claim 59, wherein said heat generated within said first interior volume is generated according to the following heat generation rates: at least about 1000 watts from said post fuser cooler, at least about 300 watts from said cooling auxiliary fan, at least about 1000 watts from said paper cooler, at least about 300 watts from each of said pre-cooling auxiliary fan and said post-cooling auxiliary fan, at least about 2500 watts from said paper heater, and at least about 4000 watts from said one or more pathways through frame portions included in said first interior volume.

61. The air quality management apparatus according to claim 58, said fusing station including a fuser, wherein a fusing-station-related flow of air included in said air flowing through and included in said first interior volume flow proximate to said fusing station yet not through said fusing station, said fusing-station-related flow carrying fuser oil volatiles emitted by said fuser away from said fuser, wherein said fusing station is sited within said first interior volume at a location such that substantially none of said fuser oil volatiles reaches said modules via said leakage flow rate of air from said first interior volume to said second interior volume, said fuser oil volatiles being swept away by said fusing-station-related flow for inclusion in said expelled air.

62. The air quality management apparatus according to claim 1, wherein said managing of an air quality of air included in and circulating within said interior volume includes removing excess heat generated within said second removing said excess heat by said air-conditioning device.

63. The air quality management apparatus according to claim 62, wherein heat generated within said second interior volume is generated according to the following heat generation rates: at least about 500 watts from said image writers, at least about 500 watts said modules in addition to said image writers, at least about 2250 watts from said at least one air recirculation device, and at least about 1500 watts from heat-generating devices housed in said auxiliary chambers included in said second interior volume, said auxiliary chambers associated with and not included in said modules, said heat-generating devices for operating said recirculation portion, said heat-generating devices including mechanical devices, power supplies, motors, electrical equipment, and electrical circuit boards.

64. The air quality management apparatus according to claim 1, wherein said at least one air recirculation device includes a main blower for blowing said at least one post-exit airflow into and through said plurality of pathways included in said second interior volume.

65. A method for managing quality of air within an electrostatographic printer having a paper conditioning station associated therewith, said printer for making color images on receiver members, said air included in a first interior volume and in a second interior volume within said printer, said second interior volume including a plurality of electrostatographic image-forming modules, said first interior volume including paper handling equipment, a fusing station and a post-fusing cooler, said second interior volume differentiated from said first interior volume by at least one separating member, said method for managing air quality comprising the following steps:

flowing an airflow through said first interior volume, said airflow originating as a filtered intake flow of ambient air flowing from outside said printer into said first interior volume via at least one inlet port, said airflow including an outflow of air flowing at a predetermined rate of flow out of said first interior volume via at least one outlet port to a location outside said printer, said filtered intake flow compensating said outflow, said outflow carrying away through said exit port excess heat and aerial contaminations generated within said first interior volume;

causing air within said second interior volume to be recirculated through an air-conditioning device for providing a plurality of air-conditioned airflows, said plurality of air-conditioned airflows passing through a plurality of pathways within said second interior volume, a respective air-conditioned airflow included in said plurality of air-conditioned airflows having a respective temperature and a respective relative humidity, said respective temperature and said respective relative humidity measured for said respective air-conditioned airflow leaving said air-conditioning device, said respective air-conditioned airflow for delivery to a respective designated location within said second interior volume, said respective designated location inclusive of: said modules, any components of said modules, and any devices for operating said modules;

establishing, for said plurality of recirculating airflows within said second interior volume, a predetermined total rate of recirculation of air for recycling through said air-conditioning device;

providing at least one filtering unit for removing aerial contaminations from said air for recycling by said air-conditioning device; and providing a determinate leakage path for a pre-specified amount of air leakage between said first interior volume and said second interior volume.

66. The method for managing air quality according to claim 65, wherein said pre-specified amount is substantially zero.

67. The method for managing air quality according to claim 65, wherein said predetermined rate of flow of air flowing out from said first interior volume is approximately equal to said specified total rate of recirculation of air circulating within said second volume.

* * * * *